US009915177B2

(12) United States Patent
Howes et al.

(10) Patent No.: US 9,915,177 B2
(45) Date of Patent: Mar. 13, 2018

(54) CONTROL OF SYSTEM WITH GAS BASED CYCLE

(71) Applicant: Energy Technologies Institute, LLP, Loughborough, Leicestershire (GB)

(72) Inventors: Jonathan Sebastian Howes, Hampshire (GB); James Macnaghten, Hampshire (GB); Rowland Geoffrey Hunt, Hampshire (GB)

(73) Assignee: ENERGY TECHNOLOGIES INSTITUTE LLP, Leicestershire (GB)

( * ) Notice: Subject to any disclaimer, the term of this patent is extended or adjusted under 35 U.S.C. 154(b) by 512 days.

(21) Appl. No.: 14/397,806

(22) PCT Filed: Mar. 11, 2013

(86) PCT No.: PCT/GB2013/050593
§ 371 (c)(1),
(2) Date: Oct. 29, 2014

(87) PCT Pub. No.: WO2013/164564
PCT Pub. Date: Nov. 7, 2013

(65) Prior Publication Data

US 2015/0211386 A1 Jul. 30, 2015

(30) Foreign Application Priority Data

Apr. 30, 2012 (GB) ..... 1207497.7

(51) Int. Cl.
*F01K 3/12* (2006.01)
*F01K 3/02* (2006.01)
(Continued)

(52) U.S. Cl.
CPC ..... *F01K 3/02* (2013.01); *F01K 3/12* (2013.01); *F01K 7/00* (2013.01); *F01K 7/16* (2013.01)

(58) Field of Classification Search
CPC ..... F01K 3/02; F01K 3/12; F28D 20/0056; Y02E 60/142; Y02E 60/145; Y02E 60/15
See application file for complete search history.

(56) References Cited

U.S. PATENT DOCUMENTS

2006/0039795 A1 2/2006 Stein et al.
2007/0051103 A1 3/2007 Bar-Hai
(Continued)

FOREIGN PATENT DOCUMENTS

EP 2400120 12/2011
GB 482686 4/1938
(Continued)

OTHER PUBLICATIONS

Corrected Written Opinion in corresponding PCT Application No. PCT/GB2013/050593, dated Feb. 28, 2014, 16 pages.
(Continued)

*Primary Examiner* — Jonathan Matthias
(74) *Attorney, Agent, or Firm* — Kenealy Vaidya LLP

(57) ABSTRACT

System (2) for carrying out a gas based thermodynamic cycle in which a gas is compressed in at least one compressor (8) in one part of the cycle and is expanded in at least one expander (10) operating simultaneously in an upstream or downstream part of the cycle, wherein the change in absolute internal power with gas mass flow rate differs as between the compressor and the expander and wherein the system comprises a control system configured to make selective adjustments so as individually to control, either directly or indirectly, the respective gas mass flow rates through each of the compressor and expander. The system may be an energy storage system including a pumped heat energy storage system configured to provide independent
(Continued)

graduated control of system pressure and output power by selective adjustment of the respective gas mass flow rates through each half-engine.

17 Claims, 12 Drawing Sheets

(51) Int. Cl.
*F01K 7/00* (2006.01)
*F01K 7/16* (2006.01)

(56) References Cited

U.S. PATENT DOCUMENTS

| | | | | |
|---|---|---|---|---|
| 2010/0218500 | A1 | 9/2010 | Ruer | |
| 2010/0251711 | A1 | 10/2010 | Howes et al. | |
| 2010/0287934 | A1* | 11/2010 | Glynn | F01K 17/06 60/645 |
| 2010/0301614 | A1* | 12/2010 | Ruer | F01K 3/12 290/1 A |
| 2010/0303657 | A1 | 12/2010 | Kuttler et al. | |
| 2011/0016864 | A1 | 1/2011 | Wright et al. | |
| 2011/0061379 | A1 | 3/2011 | Misselhorn | |
| 2011/0076160 | A1 | 3/2011 | Schroeder et al. | |
| 2011/0127004 | A1 | 6/2011 | Freund et al. | |
| 2012/0060501 | A1 | 3/2012 | Hemrle et al. | |
| 2012/0080168 | A1 | 4/2012 | Hemrle et al. | |

FOREIGN PATENT DOCUMENTS

| | | |
|---|---|---|
| GB | 2482416 | 2/2012 |
| JP | 63-253102 | 10/1988 |
| WO | 2012013978 | 2/2012 |
| WO | 2013026992 | 2/2013 |

OTHER PUBLICATIONS

European Combined Search and Examination Report in British Patent Application No. GB1304354.2, dated Sep. 5, 2013, 6 pages.
European Search and Examination Report in GB1304354.2, dated May 27, 2014, 3 pages.
European Search Report in GB1207495.1, dated Aug. 30, 2012, 4 pages.
European Search Report in GB1207497.7, dated Aug. 16, 2012, 5 pages.
International Search Report in PCT application No. PCT/GB2013/050593, dated Feb. 17, 2014, 3 pages.

* cited by examiner

CONTROL OF SYSTEM WITH GAS BASED CYCLE

RELATED APPLICATION DATA

This U.S. national phase application is based on international application no. PCT/GB2013/050593, filed on Mar. 11, 2013, which claimed priority to British national patent application no. 1207497.7, filed on Apr. 30, 2012. Priority benefit of these earlier filed applications is hereby claimed.

TECHNICAL FIELD OF THE INVENTION

The present invention relates to a system for carrying out a gas based thermodynamic cycle and to a method of operating such a system. In particular, it relates to an energy storage system, which may be a system for receiving and returning energy in the form of electricity (i.e. electricity storage system), especially a pumped heat electricity storage (PHES) system.

BACKGROUND OF THE INVENTION

Applicant's earlier Application WO 2009/044139 discloses a thermodynamic electricity storage system using thermal stores. In the most basic configuration, a hot store and a cold store are connected to each other by a compressor and expander (the latter is often referred to as a turbine in axial flow machinery). In a charging mode heat is pumped from one store to the other (i.e. heating the hot store and cooling the cold store) and in a discharge mode the process in the system is reversed (i.e. with the cold store being used to cool gas prior to compression and heating in the hot store). The systems can use a variety of different types of compressors and expanders, some examples are reciprocating, rotary screw, sliding vane, axial or centrifugal. The thermal stores can use a thermal storage medium, such as a refractory like alumina, or a natural mineral like quartz.

The cycles used in the system of WO 2009/044139 may be run as closed cycle processes or as open cycle systems (e.g. where there is one stage that is at near ambient temperature, atmospheric pressure and the working fluid is air). When running as a closed cycle, the working gas may advantageously be a monatomic gas such as argon which has a high isentropic index (i.e. for a given pressure change a higher temperature rise is achieved than for a diatomic gas such as nitrogen).

The present Applicant has identified the need for a system for carrying out a gas based thermodynamic cycle with improved system control.

SUMMARY OF THE INVENTION

The present invention provides a system for carrying out a gas based thermodynamic cycle in which gas is compressed in at least one compressor in one part of the cycle and expanded in at least one expander in another part of the cycle, wherein the change in absolute internal power (i.e. compressor power or expander power (or half-engine power—as discussed below, machinery acting as a compressor or as an expander)) with (change in) gas mass flow rate differs as between the compressor and the expander and wherein the system comprises a control system configured to make selective adjustments so as individually to control, either directly or indirectly, the respective gas mass flow rates in each of the compressor and expander.

The system or apparatus for carrying out a gas based thermodynamic cycle may comprise a heat pump or a heat engine apparatus, or apparatus incorporating both types of cycle, in which the respective operating temperatures of the compressor and expander differ.

The gas (working gas) may be expanded and compressed in an open or closed thermodynamic cycle, and the compressor and expander may be connected in series within the cycle so as to process the working gas upstream or downstream of each other, usually sequentially connected with a heat transfer stage disposed inbetween (e.g. a thermal store).

The control system may be configured to provide independent control of two (e.g. unrelated) system variables, and this may be graduated control.

The graduated (or progressive) control may be stepwise (increasing in discrete steps) or continuous control, depending on the type of system and type of compressor/expander and how finely they permit the gas mass flow rates to be adjusted. For example, in turbomachinery variable geometry vanes or variable speed drives may allow continuous adjustment, while multi-stage devices, where stages are switched on and off (or bypassed), may provide more stepwise control of individual gas mass flow rates in the compressor or expander.

The control system may be configured selectively to adjust the respective (i.e. individually adjust) gas mass flow rates in each of the compressor and expander (e.g. in a graduated manner) so as to provide independent graduated control of two system variables.

Such a system may provide independent graduated control of two system variables and this may be done by selective graduated adjustment of the respective gas mass flow rate through each compressor/expander/half-engine. The variables may be a power variable, such as external power input and/or output, and a pressure or pressure related variable associated with the system, such as, for example, a minimum or maximum pressure, or a pressure ratio, or, a pressure related variable, i.e an indirect variable such as, for example, a maximum or minimum temperature or temperature ratio.

The two system variables (such as, for example, power and the rate of change of pressure ratio) may be two mutually independent variables. These are considered mutually independent if, at any time, the system may be operated in such a way that one of the system variables may be held constant without constraining the value of the second, within some finite range of control of the second variable, or vice versa. Pressure ratio and maximum temperature provide an example of two system variables which may not be mutually independent, because an increase in pressure ratio between the low-pressure and high-pressure ports of a simple compressor is usually associated with a rise in temperature ratio between those ports.

In a preferred embodiment, the system comprises an electricity energy storage system comprising:

a first stage comprising: a hot half-engine which acts as a compressor during charging and as an expander during discharging; and a first heat store for receiving and storing thermal energy from gas compressed by the hot half-engine in charging mode, and which transfers thermal energy to the gas compressed by the cold half-engine in discharging mode;

a second stage comprising: a cold half-engine which acts as an expander for receiving gas from the first heat store during charging and which acts as a compressor driving gas into the first heat store during discharging; and a second heat store for transferring thermal energy to gas expanded by the cold half-engine during charging, and receiving and storing thermal energy from gas expanded by the hot half-engine during discharging. This system for storing and returning electricity (as pumped heat) is hereinafter referred to as a pumped heat energy storage system or PHES.

The terminology 'hot half-engine' and 'cold half-engine' is used throughout for clarity and simplicity to reference one or more, combined or separate, machines in each respective first and second stage, which machine(s) are capable of providing the compressing function and the expanding function. The terminology is helpful for understanding that the system works as a heat engine/heat pump, with each half-engine providing either a compressing function or an expanding function, depending on whether the system is in charging or discharging mode, and in that, in the first stage, the one or more machines (i.e. hot half-engine) that conduct the compression or expansion will always be hotter than the machine(s) (i.e. cold half-engine) in the second stage. Thus, the half-engines may comprise a single reversible machine, or respective machines (e.g. arranged in parallel), to carry out the respective expansion and compression functions, as required.

The half-engines are processing gas between different respective temperature ranges and therefore, for example, for the same change in mass flow rate, the resulting change in hot half-engine power will be significantly different to the change in cold half-engine power. By configuring the control system to selectively and independently adjust the respective gas mass flow rates through the hot and cold half-engines, it is possible to achieve control of system variables.

The system may be configured to use an external power input during a charging mode and to generate an external power output during a discharging mode; and, the system may comprise a control system configured to provide independent graduated control of a pressure or pressure related variable associated with the system and independent graduated control of the external power of the system by selective adjustment of the gas mass flow rate through each half-engine.

It is highly advantageous to have independent graduated control of both external power and pressure (or a pressure related variable) in a Pumped Heat Energy Storage System (PHES), the latter variable allowing varying control of internal system state. For example, internal pressures and temperatures in the PHES are likely to require careful control during start-up and to react to changes in ambient conditions during continuous operation, in order for example to optimise energy recovery from the system. The system may also need to run within certain operating limits, for example, to avoid excessive temperatures damaging equipment or, for example, if the cold store is a thin-walled structure it may be important to keep the lowest pressure in the cold store slightly above ambient pressure to avoid collapse of low pressure pipes and the vessel and to prevent inward leaks of atmospheric air (containing water vapour) into the system.

External power may need to vary because of a varying demand from a grid operator, for example, and similarly, that operator may provide a varying supply during charging mode. This may be, for example, due to regular daily fluctuations in energy demand (popular television programmes) or because of the intermittency of a renewable energy supply connected to the grid (wind speed fluctuations). Likewise external power may be stored when there is excess generation (a large wind front) or when electricity prices are low. It should be noted that with wind, if storage is linked to a wind farm, there can be some very significant fluctuations in short term power with local wind variations. Where the operator of a wind farm has committed to provide a constant power supply for certain periods it may be necessary for the storage system to have widely fluctuating power inputs and outputs in a short period of time. For example the system might go from full input power to full output power many times in a single hour.

The pressure variable may be a pressure ratio at two parts of the system, for example, the ratio of the maximum and minimum pressures found in the system, or pressure ratios at the respective store inlets or outlets. The pressure variable may also be the highest pressure and/or the lowest pressure anywhere in the system. Usually it will be the Hot Store pressure measured at the inlet to the Hot Store or at the output from the hot half-engine (on charge) or the input to the hot half-engine (on discharge). Graduated independent control of the pressure variable advantageously will facilitate indirect independent control of other internal system variables such as, for example, temperature in the Hot Store.

The control system may utilise feedback data from measured internal system state variables (e.g. pressure or temperature) to adjust the system, or initiate a system correction, where there are set-points for the pressure variable and/or external power.

The control system may be configured to implement an algorithm using external power input/output, and a system internal condition and, optionally, an ambient condition as input, and that calculates the required respective mass flow rates of the hot and cold half-engines as output. In one embodiment in which cold store pressure is maintained at a nearly constant value (e.g. close to atmospheric pressure), the system internal condition will usually be hot store pressure measured at or near the higher temperature port of the hot store. In an alternative embodiment in which hot store pressure is maintained at a nearly constant value (e.g. close to 12 atmospheres), the system internal condition will usually be the cold store pressure measured at the higher temperature port of the cold store. The ambient condition will usually be the ambient temperature.

Advantageously, the control system is configured to provide independent control of each of power and system pressure, for example, system peak (e.g. hot store) pressure or system minimum pressure.

In one embodiment, the control system may be configured to maintain the hot store pressure (pressure at the expander input), or, the cold store pressure, within an optimum range or at an optimum value, e.g. an optimum value for energy recovery during discharge.

The control system may be configured to maintain the hot half-engine output temperature (temperature at the compressor output during charge, temperature at the expander output during discharge) within an optimum range or at an optimum value, e.g. an optimum value for energy recovery and system reliability. This may be done by adjusting the ratio between the pressure at the gas input to the hot half-engine and the pressure at the gas output from the hot half-engine. Alternatively the system may be configured to maintain the cold half-engine output temperature within an optimum range or at an optimum value.

In a perfectly adiabatic (isentropic) compression or expansion of an ideal gas (that is, one in which the working fluid does not exchange any heat with the environment) there is a well-known mathematical relationship between the ratio of the absolute pressures at the start and finish of the compression or expansion, and the ratio of the absolute temperatures at the start and finish of the compression or expansion. This relationship is:—

$$T(\text{final})/T(\text{initial})=[p(\text{final})/p(\text{initial})]\hat{}[(\text{gamma}-1.0)/\text{gamma}]$$

Here ^ denotes exponentiation and gamma is the ratio of the principal heat capacities of the gas, that is, the ratio Cp/Cv of the heat capacity Cp at constant pressure to the heat capacity Cv at constant volume. For a nearly ideal monatomic gas such as argon, gamma is very close to 5/3 and almost independent of temperature. Hence the exponent in the expression above is (5/3−1)/(5/3)=0.4. The relationship above becomes less accurate for increasingly imperfect quasi-adiabatic processes (those in which the working fluid unavoidably exchanges heat with the surroundings during the compression or expansion) but remains a good approximation for the applicant's PHES system. For example, compression of argon at pressure 1 atmosphere and absolute temperature 288K (15° C.) to a final pressure of 12 atmospheres (pressure ratio 12/1) raises its temperature to 778K (505° C.). Expansion of argon from 12 atmospheres and absolute temperature 288K (15° C.) to a final pressure of 1.5 atmospheres (pressure ratio 1.5/12=1/8) lowers its temperature to 125K (−148° C.) Hence control of the maximum system temperature (the temperature at the output of the compressor during charging) is achieved by control of the pressure ratio between the output and input ports of the compressor. For example, temperature at the output of the compressor may be maintained at 500° C. despite variation in temperature at the input to the compressor over a range between 15° C. and 55° C. In one embodiment of the PHES system this may be achieved if the second heat store is maintained at a constant pressure close to atmospheric pressure, and the pressure in the first heat store is controlled and variable between 8.6 atmospheres and 11.9 atmospheres. In an alternative embodiment, the same variation of pressure ratio may be achieved if the first heat store is maintained at a constant pressure of 12 atmospheres, and the pressure in the second heat store is controlled and variable between 1 atmosphere and 1.4 atmospheres.

In one embodiment, the control system is configured to increase (or respectively decrease) external power input/output whilst maintaining a pressure variable, optionally the hot store pressure, constant by increasing (or respectively decreasing) the respective mass flow rates through the hot and cold half-engines by the same amount.

In one embodiment, the control system is configured to control a pressure variable, optionally the hot store pressure, whilst maintaining the external power input/output constant by changing the mass flow rates through the hot and cold half-engines by selected differing amounts that do not affect the external power input/output (i.e. peak power).

While a pressure variable (e.g. hot store pressure) can be varied at a constant external power setting and a pressure variable (e.g. hot store pressure) can be maintained constant at a variable external power setting, it should be noted that a controller may be configured to vary a pressure variable (e.g. hot store pressure) and external power simultaneously by selecting the appropriate combination of mass flow rates through the hot and cold half-engines.

The engine (i.e. two half-engines) system may comprise any suitable system of gas compressor and gas expander machines, for example, rotary turbines, pumps and compressors, with axial, radial and mixed flow geometry, single or multi-stage, or positive displacement systems including rotary devices, for example, rotary screw, rotary sliding vane and linear reciprocating systems which use piston crankshaft and connecting rod arrangements.

The hot half-engine and the cold half-engine may form part of a single machine or totally separate respective machines or separate linked machines (e.g. driven by a common drive means e.g. crankshaft). The hot half-engine and the cold half-engine may each comprise multiple stages e.g. multiple compressors if compressing. These machines may be driven at the same rate or different rates depending on their connection and gearing to the output shaft.

In one embodiment, the compressors/expanders/half-engines are Linear Positive Displacement Half-Engines. The hot half-engine and the cold half-engine may undergo the same number of piston strokes per minute and be driven by the same crankshaft. Alternatively, they may undergo a different number of piston strokes per minute and be driven by different crankshafts (or the same crankshaft with variable gearing). These machines can increase the gas mass flow rate by changing the stroke rate of the pistons (increasing crankshaft speed) or by changing how the gas is allowed to enter or leave the piston chamber valves by controlling valve timing and opening durations.

The engine system may also comprise Rotary Compressor/Turbine Based Half-Engines. Axial flow compressors or turbines are formed with one or more rotor and stator stages, where the rotors are connected via a central drive shaft that is supported on bearings. Certain rotary machinery can operate with gas flows in both directions, although with limited efficiency. However, most rotary machinery is normally configured to operate with gas flows passing one direction only and hence it is necessary, for example, to have separate machinery for charge and discharge cycles of a PHES. Mass flow rates in these machines can be varied by increasing the shaft rotation speed or, if present, by varying either the rotor or stator blade angles, therefore changing the geometry associated with each stage and hence the pressure ratio.

The engine system may also comprise Rotary Positive Displacement Based Half-Engines. These positive displacement devices can be of the rotary screw type, which work on the principle of air filling the void between two helical mated screws and their housing. As the two helical screws are turned, the volume is reduced resulting in an increase of air pressure. Variable mass flow rate is feasible with these devices by modifying the effective length of the compression/expansion volume. This can be achieved by suitable placement of valves within the device. They can also be of the rotary sliding vane type, which consist of a rotor, stator and a number of radial vanes. The rotor is eccentrically arranged within the stator, providing a crescent-shaped swept area between the low and high pressure ports. Compression/expansion is achieved as the volume contained within the vanes goes from maximum/minimum at the inlet ports to minimum/maximum at the outlet ports. Variation of the eccentricity of the rotor can be used to change mass flow rate.

The engine system may also comprise Rotary Reciprocating Positive Displacement Based Half-Engines. These positive displacement devices may have a number of compression/expansion stages/chambers, usually 1 to 3 stages. They usually consist of one or more pistons in cylindrical bores that are forced to reciprocate via connection to a crankshaft and connecting rod assembly. Valves in the cylinder open and close to let gas into and out of the working chamber.

One or both half-engines may comprise multiple compressor/expander stages and the control system may be configured to control mass flow rates differentially between individual stages of the compressor/expander stages in order to maintain inter-stage pressures at the desired values. In half-engines where mass flow rates are controlled by valve timings, then the control system may be configured to control valve timing differentially between individual stages of the compressor (or expander) stages in order to maintain inter-stage pressures at the desired values.

One or both of the half-engines may be a positive displacement device, and the positive displacement device may be a reciprocating valved device through which internal power and mass flow rate is controlled by selective alteration of valve timings.

When discussing reciprocating piston assemblies and the timings of valve events it is helpful to consider volumetric flow rate rather than the mass flow rate, as the volumetric flow rate will be being directly adjusted. The reason for this is that working volume has fixed geometry and the maximum amount of gas that can be compressed each cycle is limited to this maximum working volume at the pressure of the low pressure region. Likewise, the maximum amount of gas that can be expanded each cycle is also limited by the working volume to the maximum working volume at the same pressure as the low pressure region. However, mass flow rate will be determined by the volumetric flow rate AND the temperature, pressure and type of gas, so that a change in the pressure of the low pressure region must lead to a change in the mass flow rate if the volumetric flow rate is kept constant. In a different case, a change in the pressure of the low pressure region might actually negate the effect of a change in volumetric flow rate, such that the mass flow rate is held constant even though the volumetric flow rate has changed.

The pressure in the low pressure region determines the mass flow rate as follows. A device acting as a compressor draws a fixed volume of gas in to the working volume each cycle. If we assume pressure (or more strictly, density) in the low pressure region remains constant and we increase the pressure in the high pressure region, then the mass and volumetric flows in this example remain constant ie a change in the pressure of the high pressure has no effect. In a different case, if we now increase the pressure (or more strictly density) of the low pressure region and keep the pressure in the high pressure region constant then we will automatically increase the mass flow rate even though volumetric flow rate remains constant.

Most reciprocating machines have a certain amount of gas left in the working volume at TDC called dead volume. This dead volume changes the behaviour of the working volume slightly from that described as the amount of dead volume increases. The normal result of dead volume is that a change in either high or low pressure regions may not have a directly linear effect on mass flow.

For example in a machine with no dead volume, doubling the pressure in the high pressure region will have no effect on mass or volumetric flow as previously described. However, doubling the pressure of the higher pressure region in a device with dead volume will lead to a slight reduction in both volumetric AND mass flow rate. In a different example with a device with dead volume, doubling the pressure of the low pressure region and keeping the pressure of the high pressure region constant will lead to slightly more than a doubling of mass flow AND also a slight increase in volumetric flow rate.

Generally, the larger the pressure ratio between the low pressure and high pressure regions the more the effect of the dead volume has to be taken in to account.

For a PHES control system it is important that the mass flow rate changes. The half-engines are connected to large thermal stores that normally have significant volume compared to the volume of gas processed by the half-engine per cycle, so in this situation the inlet and outlet pressures will only vary slowly ie over many cycles. Consequently a change in volumetric flow rate in this scenario will lead to an immediate equivalent change in mass flow rate. Where it is referred to that the valves control mass flow rate it is to be understood that the valve timings will be set to change volumetric flow rates such that the required change in mass flow rate occurs.

In a preferred embodiment, the device is a reciprocating piston assembly comprising a working volume respectively connected via a high pressure valve to a high pressure region and via a low pressure valve to a low pressure region. Advantageously, the device is configured such that both valves open (preferably autonomously) on pressure equalisation, and the control system is configured only to control the timing of the valve closure events.

Applicant's earlier application, WO2009074800, describes a lightweight sliding screen valve comprising a flexible multi-apertured valve plate configured for lateral reciprocation, which can conform to the face of a multi-apertured valve seat due to its flexibility and hence provide a good quality seal in response to a pressure differential across the valve, and also lock in the closed configuration in response to the pressure differential. It is designed to open automatically upon pressure equalization and is designed to open and close quickly, which makes it suitable for use in a half-engine of a PHES system and in a half-engine where gas mass flow rates are preferably only controlled by valve closure timing events.

In one embodiment, the control system is configured to modify external power input/output by changing the timing of the valve closure events so as to maintain the equality of mass flow rates through the respective half-engine sections and maintain a pressure variable, optionally the hot store pressure, unchanged.

In one embodiment, the control system is configured to modify the pressure variable by changing the timing of valve closure events so as to control the mass flow rates through the hot and cold half-engines differentially thereby changing the pressure variable, optionally the hot store pressure, whilst maintaining the external power input/output unchanged.

In one embodiment, net mass flow through the half-engine acting as an expander may be decreased (resp increased) by advancing (resp retarding) the closure of the inlet (HP) valve on the down-stroke.

In one embodiment, net mass flow through the expander may be decreased (resp increased) by advancing (resp retarding) the closure of the exhaust (LP) valve on the up-stroke.

In one embodiment, net mass flow through the compressor may be decreased (resp increased) by retarding (resp advancing) the closure of the inlet (LP) valve on the up-stroke.

In one embodiment, net mass flow through the compressor may be decreased (resp increased) by retarding (resp advancing) the closure of the exhaust (HP) valve on the down-stroke.

In one embodiment, the control system is configured to use mechanical means to determine the timing of valve closure events based on external power input/output and on at least one system internal condition.

In one embodiment, the control system is configured to use electronic means to determine the timing of valve closure events based on external power input/output and on at least one system internal condition.

In one embodiment, the control system is configured to implement an algorithm for determining the valve timing adjustments required for a given external power output/input or pressure modification which takes, as parametric input, at least one current system internal condition and at least one current system external condition, such as, for example, temperatures and pressures.

There is further provided a method of operating an electricity energy storage system comprising:

a first stage comprising: a hot half-engine which acts as a compressor during charging and as an expander during discharging; and a first heat store for receiving and storing thermal energy from gas compressed by the hot half-engine in charging mode, and which transfers thermal energy to the gas compressed by the cold half-engine in discharging mode;

a second stage comprising: a cold half-engine which acts as an expander for receiving gas from the first heat store during charging and which acts as a compressor driving gas into the first heat store during discharging; and a second heat store for transferring thermal energy to gas expanded by the cold half-engine during charging, and receiving and storing thermal energy from gas expanded by the hot half-engine during discharging; and, wherein the system is configured to use an external power input during a charging mode and to generate an external power output during a discharging mode; and, wherein the system comprises a control system configured to provide independent graduated control of a pressure or pressure related variable associated with the system and independent graduated control of the external power of the system by selective adjustment of the gas mass flow rate through each half-engine.

The method may comprise the control system independently adjusting the mass flow rates in both half-engines either to control the hot or cold store pressure while maintaining constant external power input/output or, to control the external power input/output while maintaining constant hot or cold store pressure. However, as mentioned earlier, the control system may also be configured to vary a pressure or pressure-related variable and external power simultaneously by selecting the appropriate combination of mass flow rates through the hot and cold half-engines.

There is further provided a method of operating a system for carrying out a gas based thermodynamic cycle as described above, wherein the respective gas mass flow rates are selectively independently adjusted in order to provide, preferably graduated, control of at least one system variable.

There is further provided an apparatus for compressing and/or expanding a gas comprising a positive displacement device having a space forming a working volume for compressing or expanding the gas between a lower pressure LP region and a higher pressure HP region to which it is respectively connected via at least one LP valve and via at least one HP valve, the apparatus further comprising a control system for actuating the HP and LP valves, wherein the control system is configured to run an operating mode of the apparatus in which, the timing of the respective HP and LP valve closure events changes from one matched pair to a different match pair of valve events over a series of cycles while the flow rate remains constant.

In this way, as a transitional mechanism, the valve events can be changed with the flow rate through the device remaining constant. This might be desirable to move valve timing events smoothly from one valve timing path to a second valve timing path. It can be viewed that the HP valve timing events are moved and the LP timing events are changed to follow these moves, while keeping the flow rate constant, or vice versa.

The present invention further provides any novel and inventive combination of the above mentioned features which the skilled person would understand as being capable of being combined.

BRIEF DESCRIPTION OF THE DRAWINGS

The present invention will now be described, by way of example only, with reference to the accompanying drawings in which:—

DETAILED DESCRIPTION

The present invention may be of application in any apparatus or system carrying out a gas based thermodynamic cycle comprising a compressor and expander, such as a heat engine or heat pump cycle, or both. The independent control of respective gas mass flow rates through the compressor and expander may be used to provide independent graduated control of two system variables, such as power and pressure type variables.

For example, an office air conditioning system or a cold-room refrigeration system operating as an open cycle heat pump using air as the working fluid is an example of such a system. Incoming air (from the external environment, or recirculated within the office or cold room) is compressed to an increased pressure and temperature. It is then passed through a heat exchanger in which it loses heat to the external environment at approximately constant pressure. The cooled high pressure air is then expanded back to atmospheric pressure and (because it has lost heat) to a temperature below its initial temperature. The cooled air may be delivered directly to the environment, e.g. an office environment or a cold room, or may be mixed with stale air leaving the cooled space via a counter-current heat exchanger which cools fresh ambient air entering the space.

In this application the pressure ratio may be varied to maintain a constant output temperature despite changes in input temperature, e.g. on startup. In addition the power may be varied to adjust the mass of cooled air generated and hence to maintain the correct temperature throughout the office or cold room despite changes in heat input to the cooled space, e.g. from changing solar input, the number of people or machines generating heat in the space, or from an increased frequency of door opening events which leak heat into the space.

Figure 1A:
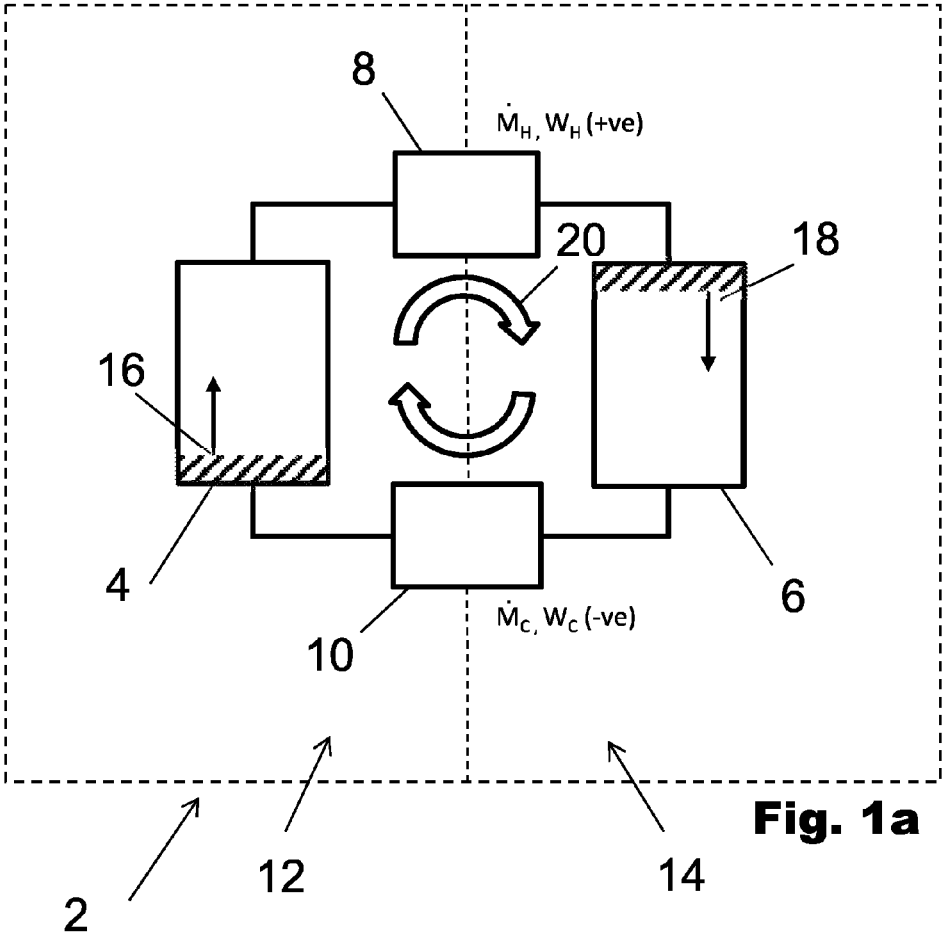
FIGS. 1*a* and 1*b* are schematics of a PHES system in charging and discharging modes, respectively.
Figure 1B:
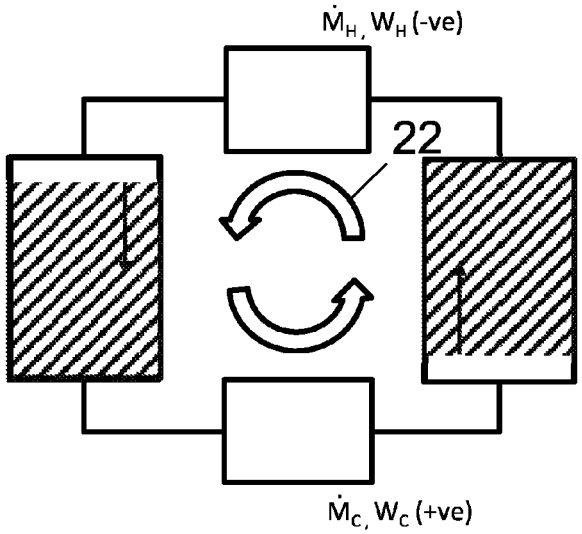

FIGS. 1*a* and 1*b*: PHES System

Applicant's earlier application, WO2009/044139, is an example of a system carrying out a gas based thermodynamic cycle. That application discloses a thermodynamic electricity storage system using thermal stores. A schematic of the pumped heat electricity storage (PHES) system is shown in FIG. 1*a*.

The system 2 is a reversible, closed cycle energy storage system operable in a charging mode (FIG. 1*a*) to store electrical energy as thermal energy, and operable in a discharging mode (FIG. 1*b*) to generate electrical energy from the stored thermal energy. The system comprises respective positive displacement devices 8 and 10, which are the hot half-engine (compressor/expander) and cold half-engine (compressor/expander), respectively, as well as a hot (higher pressure) store 6 and a cold (lower pressure) store 4. During charging, the hot half-engine 8 compresses a gas and the hot, high pressure gas then passes through the hot store 6, where it gives up its heat, before being re-expanded in the cold half-engine 10 and passing at a lower temperature and pressure through the cold store 4, where it gains heat, and returns to the start of the circuit at its original temperature and pressure. In discharge mode, as shown in FIG. 1*b*, the gas flows in the opposite direction around the circuit and the positive displacement devices are required to reverse their functions. Gas enters the cold (lower pressure) store 4 (the outlet of the store during charging is now an inlet) and gives up heat before passing, at a lower temperature, into cold half-engine 10, where it is compressed and passed, at high pressure, into the hot (higher pressure) store 6 where it gains heat, before being expanded by the hot half-engine 8 and returned to the start of the circuit at its initial temperature and pressure. The hot half-engine will therefore always process gas that is hotter than that processed by the cold half-engine, regardless of whether the system is charging or discharging.

The reversible system 2 may conduct a full charging cycle or a full discharging cycle, or may reverse its function at any point of charging or discharging; for example, if electricity is required by the national grid a charging cycle may be interrupted and the stored thermal energy converted to electrical energy by allowing the system to discharge.

It should be noted that there is a temperature gradient or 'front' that progresses within both the hot and the cold stores during charge and discharge (shown by the shaded regions of FIGS. 1*a* and 1*b*); thus, in FIG. 1*a* the hot thermal front 18 moves down the hot store 6 from the top, while the cold front 16 in the cold store 4 moves up from the bottom (so that both stores have hotter top ends). Hence, high temperature, high pressure gas enters hot store 6 at the top, but cooler (nearer ambient temperature), high pressure gas leaves the stores at the bottom (so that the stores do not heat or cool uniformly); similarly, gas entering and leaving the cold store 4 will change temperature, but will remain at the lower pressure from when it leaves the cold half-engine 10 until it returns to the hot half-engine 8. The dotted right and left hand boxes 14 and 12 therefore indicate the higher pressure and lower pressure sides of the PHES system.

Independent control of both external power and internal system state is a key control aspect of a Pumped Heat Energy Storage System (PHES). For example, it is important to maintain external power at levels requested by the operator of the electric power network both during normal operation and immediately after a grid network fault. It is also important to maintain internal system state, so that the internal pressures and temperatures in the PHES can be controlled both during start-up and to react to changes in ambient conditions during continuous operation. For example:

1. The lowest pressure in the system might need to be kept slightly above ambient pressure to avoid collapse of low pressure pipes and pressure vessels and to prevent inward leaks of atmospheric air (containing water vapour) into the system.
2. During charging, it may be important to maintain gas pressure at entry to the hot store to maintain the hot store temperature at the optimum material limited value for the stores.
3. During discharge, it may be important to maintain hot store exit pressures prior to expansion to optimise energy recovery from the system.
4. A change in ambient conditions may necessitate a change to the hot store temperatures and pressures to obtain the most power either into or out of the PHES.

Graduated (e.g. stepwise or continuous) independent control of power and internal state is preferable accurately to follow grid demand, and give reduced loading on the mechanical components (an instantaneous switch from charge to discharge would impose significant loads on the moving components of the heat engine system, unlike a more gradual change in power) and allow fine control of system state (e.g. continuously to react to ambient conditions). Both external power delivery and internal system state can be controlled independently in a PHES where there is independent control of the gas mass flow rate (and hence internal power) through both the compressor and the expander stages within the system (i.e. through both half-engines).

The mass flow rates, $\dot{M}_H$ and $\dot{M}_C$, through the hot and cold half-engines (also referred to as hot and cold machines) are shown on FIGS. 1*a* and 1*b*, as are the internal work of the hot machine and cold machine $W_H$ and $W_C$. Note the sign convention that Work and heat into the system are +ve.

Figure 2A:
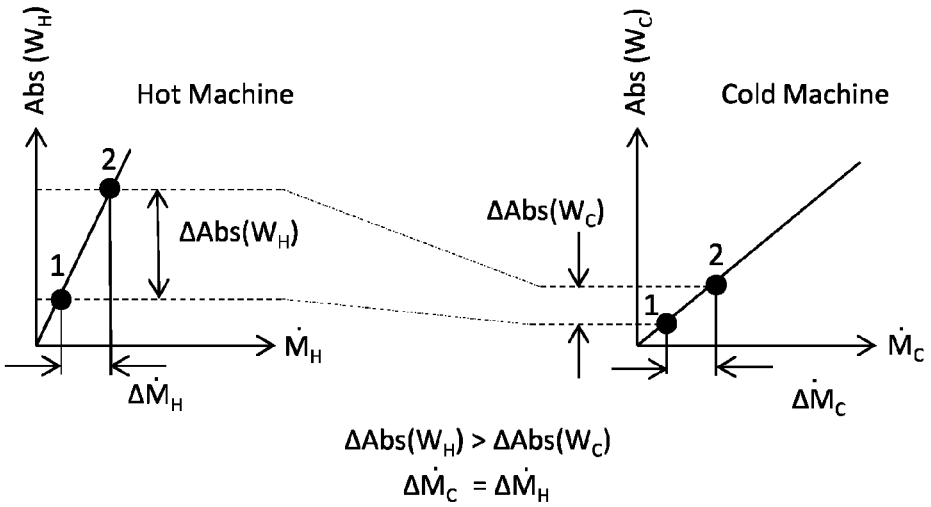
FIGS. 2*a* and 2*b* are graphs of absolute internal power against gas mass flow rate for each of the hot and cold half-engines when maintaining pressure and external power constant, respectively.
Figure 2B:
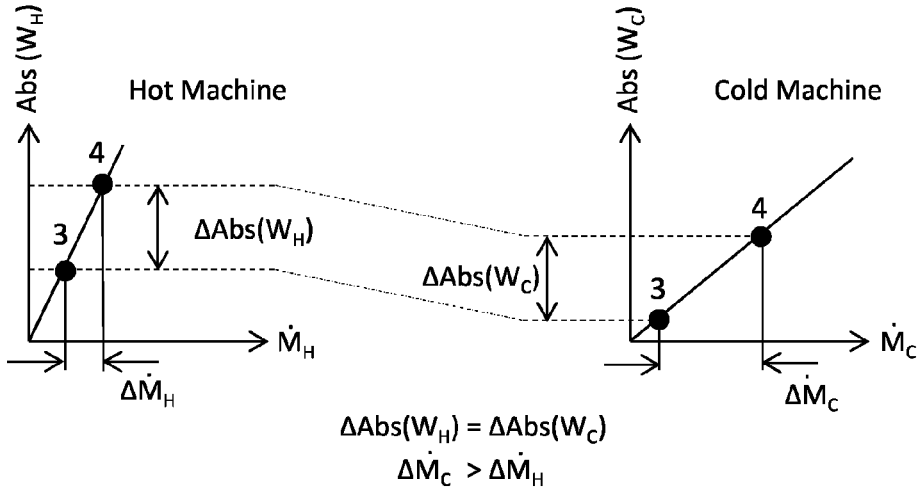

FIGS. 2*a* and 2*b*: Gas Mass Flow Rates

Referring now to FIGS. 2*a* and 2*b*, the mass of gas within the hot and cold stores (and hence the pressure within and the temperature of new gas entering the hot/cold stores) is broadly dependent on the time integral of the mass flow rates, $\dot{M}_H$ and $\dot{M}_C$, through the hot and cold half-engines (also referred to as hot and cold machines). When $\dot{M}_H=\dot{M}_C$ there is no net mass transfer of gas between the hot and cold stores and store pressures will essentially remain relatively constant. (Note: There will be slow overall changes as the system charges or discharges but this can be compensated for by other devices in the system that operate more slowly.)

By making $\dot{M}_H \neq \dot{M}_C$ there will be a net mass transfer between the hot and cold stores which will change their pressures. By making $\dot{M}_H > \dot{M}_C$ during charge, for example, a greater mass of gas will be flowing into the hot store than is flowing out of it per unit time. The total mass of gas in the hot store will therefore increase and this will result in an increase in hot store pressure. However, a change in mass flow rate will be accompanied by a change in compressor/expander power, so superficially it may therefore seem that to effect a change in hot store pressure, there must also be a net change in power into or out of the PHES.

The PHES can however be designed to exploit the fact that for the same change in mass flow rate, the resulting change in the hot machine absolute internal power ($\Delta W_H$) will inevitably be greater than the resulting change in cold machine absolute internal power ($\Delta W_C$). By making an equal change to the mass flow rates in the hot and cold machines, the total external work of the system will change, $W_T=W_H\ W_C$ with no net mass transfer of gas between the stores ($\dot{M}_H=\dot{M}_C$). This is shown in FIG. 2A.

Furthermore, by making a large change to the mass flow rate in the cold machine compared to the hot machine it is possible for there to be no change in the total external work of the system $W_T=W_H+W_C$ with a net mass transfer of gas between the stores ($\dot{M}_H\neq\dot{M}_C$), resulting in a change in store pressure. This is shown in FIG. 2B.

The following control strategies can therefore be used where the store pressures can be controlled independently of external power in/out.

Pressure Control

1) To Control Hot Store Pressure During Charge Without a Change In Power:

Increase hot store pressure by reducing the mass flow rate through both machines by differing amounts. Ensure that $|\Delta\dot{M}_H|<|\Delta\dot{M}_C|$ such that the absolute values of $W_H$ (+ve) and $W_C$ (−ve) are decreased by the same amount to ensure that $W_T=W_H+W_C$ remains constant (position 4 to 3 on FIG. 2B). Gas will then be flowing into the hot store faster than it is leaving it, resulting in a net mass increase in the hot store and an increase in store pressure.

Conversely, it is possible to decrease hot store pressure by increasing the mass flow rate through both machines by differing amounts so that the absolute values of both $W_H$ (+ve) and $W_C$ (−ve) are decreased to ensure that $W_T=W_H+W_C$ remains constant.

(Note that a change to the hot store pressure will be accompanied by an inverse change to the cold store pressure if the PHES is a closed circuit, but this can be managed by other control mechanisms.)

2) To Control Hot Store Pressure During Discharge Without a Change In Power:

Increase hot store pressure by increasing the mass flow rate through both machines by differing amounts. Ensure that $|\Delta\dot{M}_H|<|\Delta\ M_C|$ such that such that the absolute values of $W_H$ (+ve) and $W_C$ (−ve) are increased by the same amount to ensure that $W_T=W_H+W_C$ remains constant (position 3 to 4 on FIG. 2B). Gas will then be flowing into the hot store faster than it is leaving it, resulting in a net mass increase in the hot store and an increase in store pressure.

Conversely, it is possible to decrease hot store pressure by decreasing the mass flow rate through both machines by differing amounts so that the absolute values of both $W_H$ (+ve) and $W_C$ (−ve) are decreased to ensure that $W_T=W_H+W_C$ remains constant.

Power Control

3) To Control Power During Charge without a Change in Hot Store Pressure:

To reduce external power, decrease $\dot{M}_H$ and $\dot{M}_C$ by the same amount to maintain constant pressure in the hot/cold stores (position 2 to 1 on FIG. 2*a*). The resulting reduction in the absolute value of hot compressor power $W_H$ (+ve) will be significantly more than the reduction in the cold expander power $W_C$ (−ve). There will therefore be a net reduction in the absolute value of the total power $W_T$ (+ve)=$W_H$ (+ve)+$W_C$ (−ve).

Conversely, it is possible to increase the absolute value of total power $W_T$ (+ve) by increasing $M_H$ and $\dot{M}_C$ by the same amount.

4) To Control Power During Discharge without a Change in Hot Store Pressure:

To reduce external power, decrease $\dot{M}_H$ and $\dot{M}_C$ by the same amount to maintain constant pressure in the hot/cold stores (position 2 to 1 on FIG. 2*a*). The resulting reduction in the absolute value of the hot expander power $W_H$ (−ve) will be significantly more than the reduction in the absolute value of the cold compressor power (+ve). There will therefore be a net reduction in the absolute magnitude of total power $W_T$ (−ve)=$W_H$ (−ve)+$W_C$ (+ve).

Conversely, it is possible to increase the absolute value of total power $W_T$ (−ve) by increasing $\dot{M}_H$ and $\dot{M}_C$ by the same amount.

Figure 7:
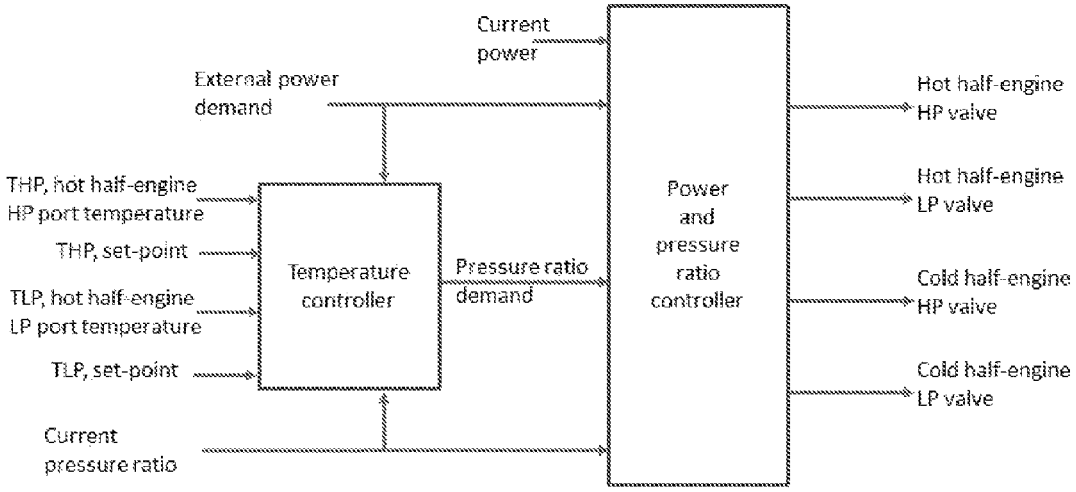
FIG. 7 is a schematic diagram of a control scheme for a PHES system.

The control scenarios outlined above have shown how hot store pressure can be varied at a constant external power setting and how hot store pressure can be maintained at a variable external power setting. It must be noted, however, that a controller can, of course, be configured to vary hot store pressure and external power simultaneously by selecting the right mass flow rates through the hot and cold machines. Such a controller would adjust mass flow rates using a combination of the previously mentioned control scenarios. FIG. 7—Example of a Control Scheme for a PHES System An embodiment comprising an exemplary control scheme for power and pressure ratio for a PHES system is described with reference to FIG. 7. The controller determines four outputs, which are the timings of valve closure events for each of the high pressure (HP) and low pressure (LP) valves in each of the hot and cold half-engines. The controller is shown as composed of two block functions, which are firstly the temperature controller sub-block and secondly the power and pressure controller sub-block.

The power and pressure ratio controller is a negative feedback controller which receives, as inputs, set-point demands for power and pressure ratio. The power and pressure ratio controller also receives the current value of the pressure ratio and optionally the current value of the power. In one embodiment, the expander mass flow is controlled by varying the closing time of the HP valve whilst fixing the closing time of the LP valve shortly before TDC. In one embodiment the compressor mass flow is controlled by varying the closing time of the LP valve whilst fixing the closing time of the HP valve near TDC. The controller determines the timing of valve closure events, setting mass flows in the hot and cold half-engines both to achieve the demanded (set-point) power and simultaneously to achieve a rate of change of pressure ratio so that the pressure ratio converges stably, and sufficiently quickly, on the set-point value. The sign of the set-point demand for power determines whether the system is in a charging or a discharging mode.

The current power is an optional input because the engine power is related to instantaneous (current) mass flow so might be controlled "open loop", i.e. without negative feedback involving the currently-measured output power, because the controller may estimate mass flow with reasonable accuracy directly from valve timings, and may estimate system losses to determine mechanical shaft power or electrical power and compare with demand. However, more precise control of power is possible if the controller also receives an input which conveys the measured current (achieved) value of power.

Current pressure ratio is an input because the rate of change of pressure ratio (rather than the pressure ratio itself) is related to the difference between mass flow rate through the hot half engine and the mass flow rate through the cold half engine. Precise control of the pressure ratio requires knowledge of its current value within the controller. In the PHES system, control of the pressure ratio is intended to achieve specific values or ranges for temperatures at critical points in the system. The temperature controller determines a target pressure ratio based on the difference between a measured temperature and a set-point value for that temperature. In charging mode, the set-point temperature may be 500° C. and the relevant measured temperature may be the temperature at the compressor output. In discharging mode, the relevant measured temperature may be the temperature at the expander output. The temperature controller has the external power demand as input, so that it may determine whether the system is in charging or discharging mode and hence which set-point and measured temperature to use. The temperature controller is also provided with the current pressure ratio as input. The temperature controller determines the difference (error) between the current measured temperature and the set-point, and modifies the pressure ratio demand to the power and pressure ratio controller in order to reduce, and eventually eliminate, the temperature error.

Figure 3:
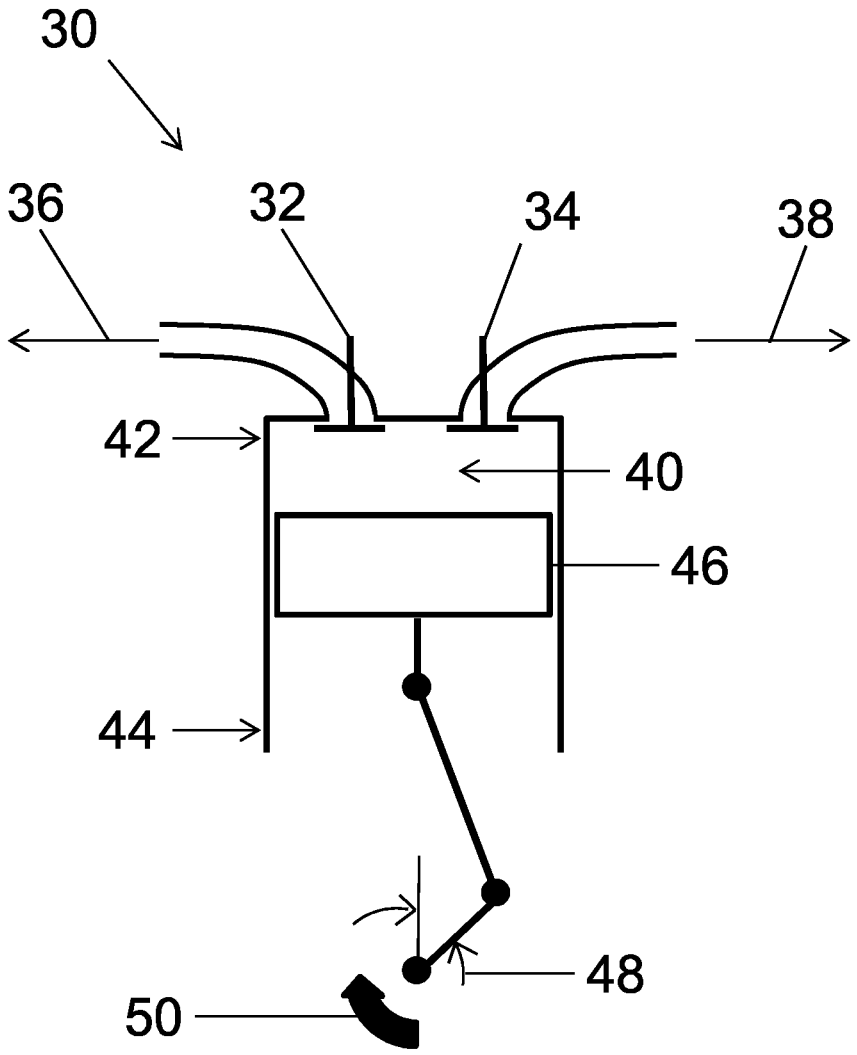
FIG. 3 is a sectional schematic view of a reciprocating compressor/expander that could form part or all of a half-engine, and which has a high pressure valve and low pressure valve.

FIG. 3—Control of Gas Mass Flow Rate in Linear Reciprocating Half-Engines

A PHES may use positive displacement machines such as reciprocating compressors and expanders. The positive displacement device may be coupled to a rotary device (e.g. rotary shaft) for transmitting mechanical power between the positive displacement device and an input/output device (e.g. a motor/generator of an electricity generator, an engine or a mechanical drive) and it may be configured to switch from a charging mode to a discharging mode while the rotary device continues to move in a predetermined direction associated with the first mode.

Whilst a PHES system could be configured with a variable speed drive to both the hot and cold half-engines to control mass flow rates independently in each machine, such a system would add extra complexity and gearing that is not required with such devices. Instead, it is preferable for such devices to be configured so that they are rotated by a common crank and the compressor/expander mass flow rates are controlled by varying the valve events.

A simplified example of a reciprocating piston assembly acting as a compressor/expander 30 is shown in FIG. 3. A piston 46 is attached to a connecting rod coupled to a crankshaft and reciprocates linearly within a chamber from BDC—Bottom Dead Centre 44 back up to TDC—Top Dead Centre 42, its position being determined by crank angle 48 of crank 50. There is always some gas left in the chamber at TDC and the amount of space available for this gas in the chamber is normally referred to as Dead Volume. The chamber comprises at least one higher pressure HP valve 32 that selectively connects the chamber 40 to a higher pressure space 36 and at least one lower pressure LP valve 34 that selectively connects the chamber 40 to a lower pressure space 38.

In the compression mode, the first and second valves are configured to allow gas to pass from the low pressure region to the chamber and to allow compressed gas to pass from the chamber to the high pressure region. In the expansion mode, the first and second valves are configured to allow gas to pass from the high pressure region to the chamber and to allow expanded gas to pass from the chamber to the low pressure region.

The timing of the high and low pressure valve events will determine the volumetric flow rate through both the hot and cold machines (whether the reciprocating units are working as either compressors or expanders) and therefore mass flow rate and hence external power and internal state (e.g. hot store pressure) can then be controlled independently using the strategies already outlined above.

FIGS. 4-6 and 8-9: Valve Timing Diagrams

Circular timing diagrams will now be presented that show typical valve timings for the control of either expander or compressor power. An example timing diagram for a compressor is shown initially in FIG. 4.

Figure 4:
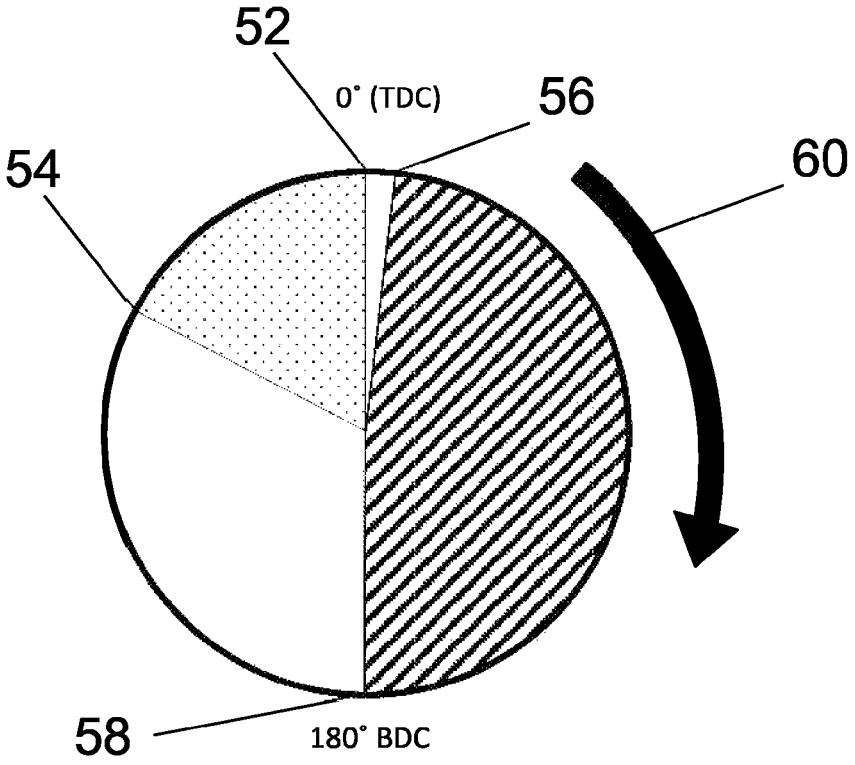
FIG. 4 is an example of a valve timing (circle or sector) diagram for a compressor showing opening and closing events for both the high pressure and low pressure valves.

With reference to FIG. 4: The angular position around the diagram in the clockwise direction 60 from the vertical is equivalent to crankshaft angle from piston TDC. The striped areas represent periods for which the low pressure (LP) valves are open, the dotted areas represent periods for which the high pressure (HP) valves are open and the white areas represent periods where both the low pressure and the high pressure valves are closed.

From 0° (TDC) at 52, the crankshaft rotates clockwise and the piston starts to move down. Just after TDC, at 56 the low pressure valve will open (ideally on pressure equalisation with the low pressure side) and as the piston moves down low pressure gas flows into the compression chamber. At 58 at 180° (BDC), the low pressure valve closes. After BDC, the piston moves up, compressing the gas within the compression chamber. At some point 54 in the compression stroke, the high pressure valve will open (ideally on pressure equalisation with the high pressure side) and the high pressure gas in the compression chamber will transfer out of the compressor until the high pressure valve closes at 52 at TDC.

The valve timing diagrams presented in FIGS. 5, 6, 8 and 9 show how the valve timings might change when varying volumetric (and mass) flow rate through and hence the internal power in the reciprocating units when operating as either expanders or compressors.

Figure 5A:
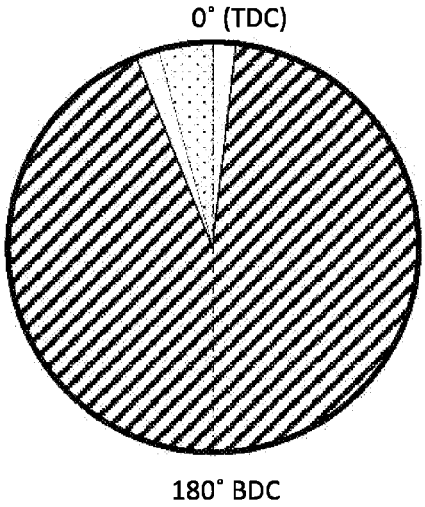
FIGS. 5*a*, 5*b* and 5*c* are valve timing diagrams for a compressor at low, medium and high power on Path 1.
Figure 5B:
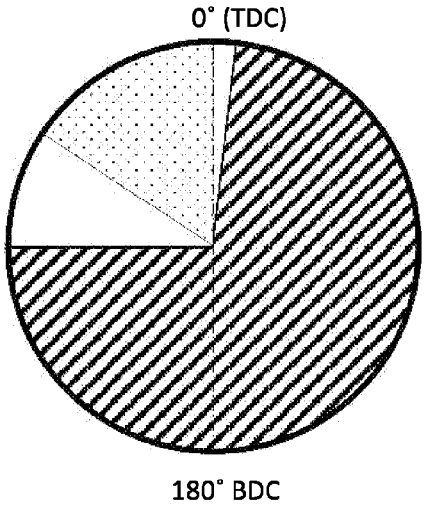
Figure 5C:
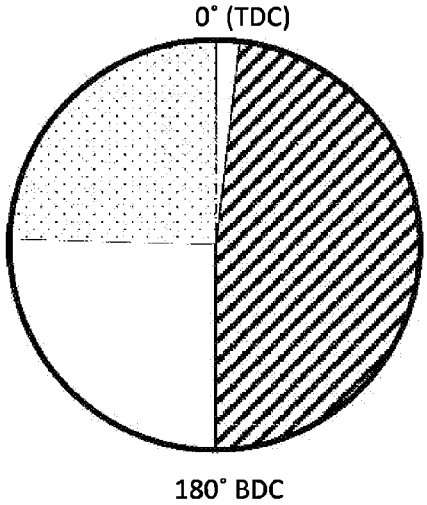
Figure 6A:
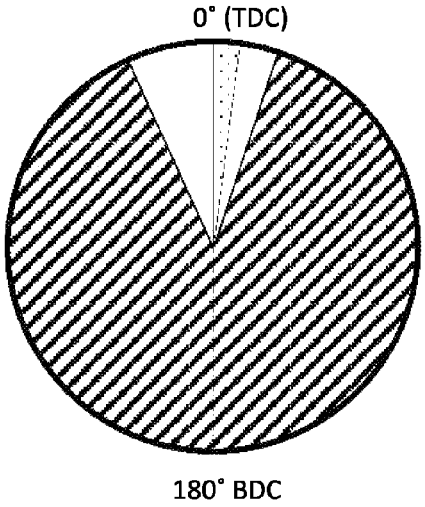
FIGS. 6*a*, 6*b* and 6*c* are valve timing diagrams for an expander at low, medium and high power on Path 1.
Figure 6B:
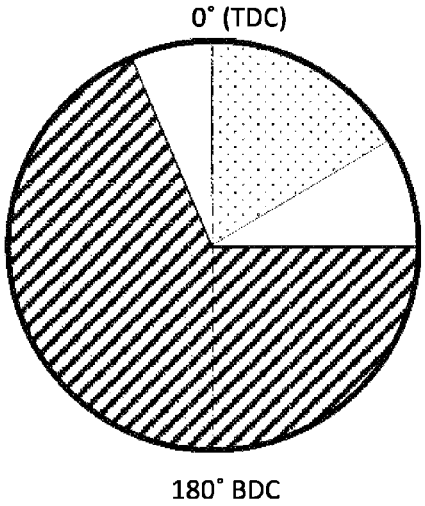
Figure 6C:
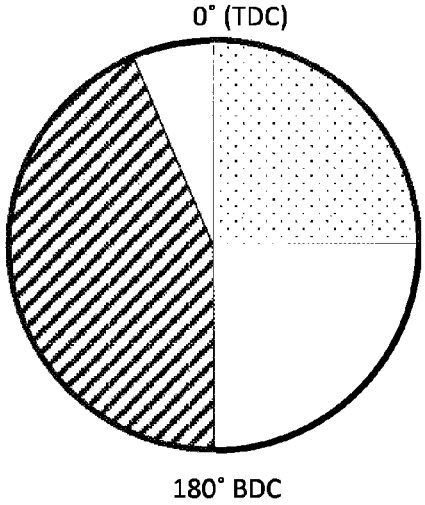

Referring to FIGS. 5 and 6, these show a thermodynamically preferred way of operating a compressor (FIG. 5) and an expander (FIG. 6), where only the closure timings of the inlet valve are altered. FIGS. 5*a*, 5*b* and 5*c* are valve timing diagrams for the compressor running at low, medium and high power. Net volumetric/mass flow through the compressor, and hence compressor power, may be decreased (i.e. 5*c* to 5*a*) (resp increased) by retarding (resp advancing) the closure of the inlet (LP) valve on the up-stroke, this being a thermodynamically preferred option whilst using almost the full intake stroke for intake (without changing the HP outlet valve closure time). Similarly, FIGS. 6*a*, 6*b* and 6*c* are valve timing diagrams for the expander at low, medium and high power. Net mass flow through the half-engine acting as an expander may be decreased (i.e. 6*c* to 6*a*) (resp increased) by advancing (resp retarding) the closure of the inlet (HP) valve on the down-stroke, whilst using almost the full exhaust stroke for exhaust (without changing the LP outlet valve closure time). Hence, it is possible gradually (i.e. stepwise or continuously) to vary gas mass flow rate by varying the angle of the valve closure event of the inlet valve.

Figure 8A:
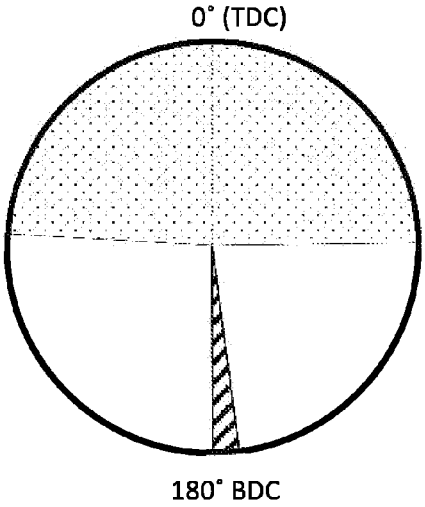
FIGS. 8*a*, 8*b* and 8*c* are valve timing diagrams for a compressor at low, medium and high power on Path 3; and, FIGS. 9*a*, 9*b* and 9*c* are valve timing diagrams for an expander at low, medium and high power on Path 3.
Figure 8B:
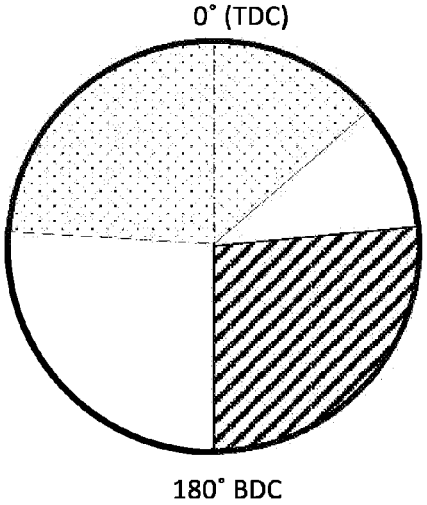
Figure 8C:
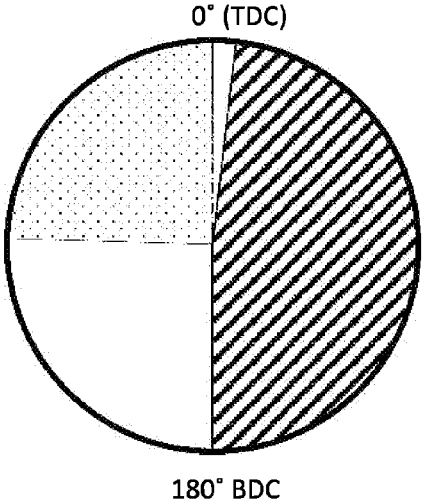
Figure 9A:
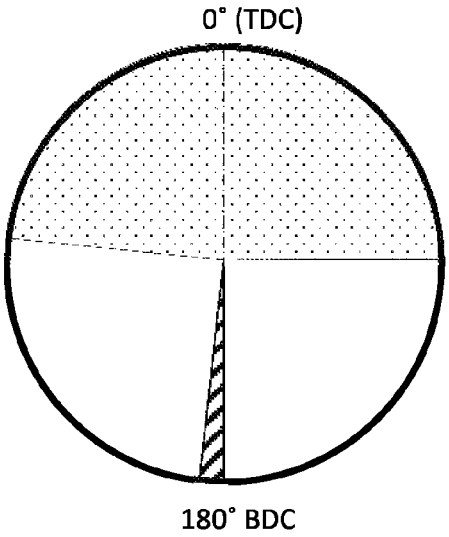
Figure 9B:
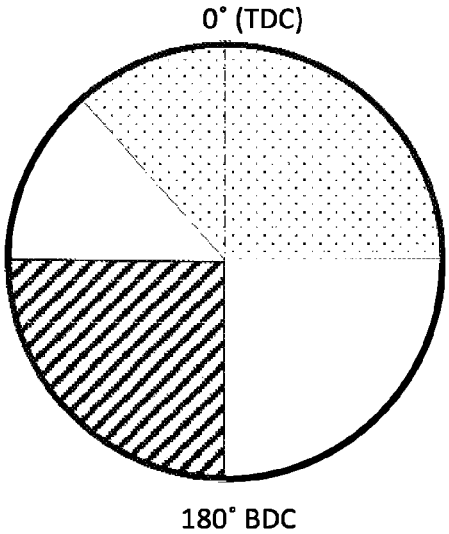
Figure 9C:
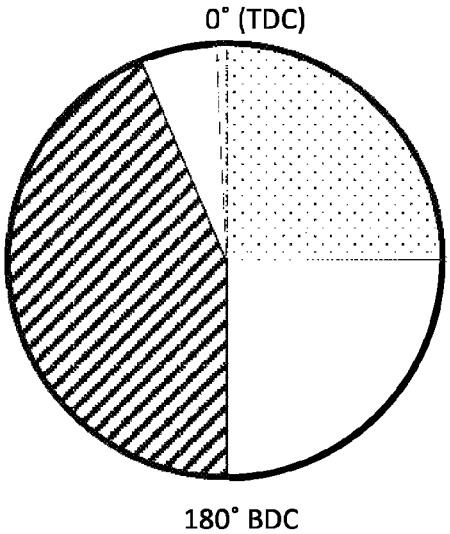

Referring to FIGS. 8 and 9, these show an alternative (but less thermodynamically preferred) way of operating a compressor (FIG. 8) and an expander (FIG. 9) where only the exhaust valve timings are altered. FIGS. 8*a*, 8*b* and 8*c* are valve timing diagrams for the compressor at low, medium and high power. Net mass flow through the compressor may be decreased (i.e. 8*c* to 8*a*) (resp increased) by retarding (resp advancing) the closure of the exhaust (HP) valve on the down-stroke, whilst using almost the full exhaust stroke for compression and outward transfer to HP, resulting in re-expansion of gas which had been compressed (without changing the closure time of the LP inlet valve closure). FIGS. 9*a*, 9*b* and 9*c* are valve timing diagrams for an expander at low, medium and high power. Net mass flow through the expander may be decreased (9*c* to 9*a*) (resp increased) by advancing (resp retarding) the closure of the exhaust (LP) valve on the up-stroke, whilst using almost the full inlet stroke for inward transfer from HP and expansion, resulting in re-compression of gas which had been expanded (without changing the closure time of the HP inlet valve closure). Hence, it is possible gradually (i.e. stepwise or continuously) to vary gas mass flow rate by varying the angle of the valve closure event of the exhaust valve.

Note that there are other valve timings that would give zero mass flow through the reciprocating unit. An example would be keeping one of the valves open (either HP or LP) and the other closed for the whole cycle.

Discussion of Machine Type

Note that the above control strategies are independent of the machine (half-engine) type. While the referenced prior art system uses reciprocating compressors and expanders, this strategy could be equally applied to turbomachinery systems, that may use axial compressors and turbines. Such systems could use one of the following approaches to control gas mass flow rates in the respective machines:

- Variable geometry vanes.
- Variable speed drives (some form of continuously variable gearing to vary machine shaft speed in relation to synchronous speed).
- Multi-stage devices, where stages are switched on and off (or bypassed) in response to a required change in mass flow rate.

It may also be possible to use this strategy on non-reciprocating positive displacement devices in a PHES, such as sliding vane compressors or rotary screws. Mass flow in a rotary screw, for instance, can be controlled by varying or modifying the effective length of the rotor compression/expansion volume (by suitable placement of valves at the inlet or exit of the device).

There is further provided a system for carrying out a gas based thermodynamic cycle in which gas is compressed in at least one compressor in one part of the cycle and expanded in at least one expander in another part of the cycle, wherein the change in internal power with gas mass flow rate differs as between the compressor and the expander and wherein the system comprises a control system configured selectively to adjust the respective gas (e.g. volumetric or mass) flow rates in each of the compressor and expander.

The term "internal power" is used in the phrase "wherein the change in internal power with gas mass flow rate differs as between the compressor and expander" because it is difficult concisely to discuss mechanical power in a way that covers both reciprocating devices and say turbomachinery; for example, a non-reciprocating device does not have an identifiable cycle. An alternative phrase for "internal power" would be the "magnitude of the time-averaged value of mechanical power with time-averaged gas mass flow rate", and an alternative way of stating the requirement for differential flow would be to say wherein the change in the magnitude of the mechanical work (per cycle if applicable) with the mass of gas transferred (per cycle if applicable) differs as between the compressor and the expander.

The control system may be configured selectively to adjust the respective (i.e. individually adjust) gas mass or volumetric flow rates in each of the compressor and expander (e.g. in a graduated manner) so as to provide control of two system variables.

It will be clear to the skilled person that modifications may be made to the above described systems or methods, including combining elements of one or more of the above described embodiments and/or aspects of the invention, without departing from the scope of the invention as set out in the following claims. Thus, while a pumped heat energy storage system has been described, the invention is also applicable to other thermo-mechanical systems (i.e. systems with a cycle involving simultaneous gas compression and expansion, as well as some form of heat transfer in the cycle) and running gas based thermodynamic cycles.

The aspect of the invention described above, the first aspect, relates to the control of a system for carrying out a gas based thermodynamic cycle in which the respective gas flow rates are selectively adjusted in the compressor and expander to assist in system control.

SECOND ASPECT

A second aspect of the invention will now be described which concerns the sophisticated control of valve timing events in a positive displacement device and which may therefore be used in order to vary flow rates in accordance with the first aspect.

TECHNICAL FIELD OF THE INVENTION

The present invention, in this second aspect, relates to an apparatus for compressing and/or expanding a gas comprising a positive displacement device and in particular a linear displacement device and methods of operating that apparatus.

BACKGROUND OF THE INVENTION

A common problem in reciprocating gas compressors is how to reduce (or change) volumetric flow rates from normal (full capacity) to a lower rate. Most gas compressors use plate or reed valves where the pressure drop across the valve acts to open the valve. There is normally a spring to help ensure that the valve returns to the closed position. However, because there is a spring, these valves are highly susceptible to hitting resonant conditions which can end up destroying the valve in a short period of time. One of the options for reducing volumetric flow rates is to use a variable speed drive so that the number of cycles per second is varied in line with demand. Unfortunately the variable speed also greatly increases the likelihood that a valve will suffer from resonance issues at certain speeds (frequencies). In addition, large variable speed drives are generally more complicated (and hence more expensive) than fixed speed drives.

The valves in gas compressors are normally passive devices and it has been an object of much study to improve them so they can be actively controlled. One solution that has been developed uses a hydraulically powered plunger to hold the inlet (low pressure—LP) valve open for part of the discharge stroke, so that some of the air drawn in through the low pressure inlet is blown back out of the cylinder. In this way it is possible to vary the volumetric flow rate.

In a combustion engine, the valves are actively controlled, for example, by a cam shaft and timing chain. This means that these types of valves are also suitable for acting in both gas compressors and gas expanders, where the timing of the valves must be varied. This can be carried out by changing the camshaft timing for example using hydraulic phasers.

In accordance with a second aspect, there is provided an apparatus for compressing and/or expanding a gas comprising a positive displacement device having a space forming a working volume for compressing or expanding the gas between a lower pressure LP region and a higher pressure HP region to which it is respectively connected via at least one LP valve and via at least one HP valve, the apparatus further comprising a control system for actuating the HP and LP valves, wherein the control system is configured to run an operating mode of the apparatus in which, during at least one cycle, there is either a net gas flow from the LP to HP region, or, a net gas flow from the HP to LP region, as well as bidirectional flow of gas through both the at least one HP valve and at least one LP valve in that mode of operation. By "bidirectional flow" is meant that within one cycle, the flow through a valve goes through in one direction and then reverses to go through in the opposite direction (as opposed to split flow simultaneously in both directions through a valve).

Hence, in accordance with the invention, the apparatus is configured with a (e.g. pre-programmed) mode of operation involving bidirectional flow through one of the valves. Valve closure settings that involve this bidirectional flow will usually be calculated using a relationship that links the respective LP and HP valve settings as matched pairs. Where the % compression (or expansion) power is being modulated, these bidirectional valve settings may be used as stepping stones to go between other more thermodynamically desirable or mechanically optimised valve timing paths (which may not involve pairs of settings with bidirectional flow).

Cycle means a full reciprocation from TDC to BDC and back to TDC.

100% compression flow rate means the maximum volumetric flow of LP gas compressed through apparatus per cycle. 100% expansion flow rate means the maximum volumetric flow of HP gas that has been expanded through apparatus per cycle.

In one embodiment, the amount of bidirectional flow (i.e. by which is meant the actual amount of reverse flow) through each of the at least one HP valve and at least one LP valve exceeds 5% (or even 10%) either of the 100% compression flow rate and/or of the 100% expansion flow rate.

In one embodiment, the bidirectional flow through one of the at least one HP and LP valve changes to unidirectional flow in other cycles of that mode of operation.

In one embodiment, the flow through both the at least one HP and LP valve is unidirectional in other cycles of that mode of operation.

Figure 12:
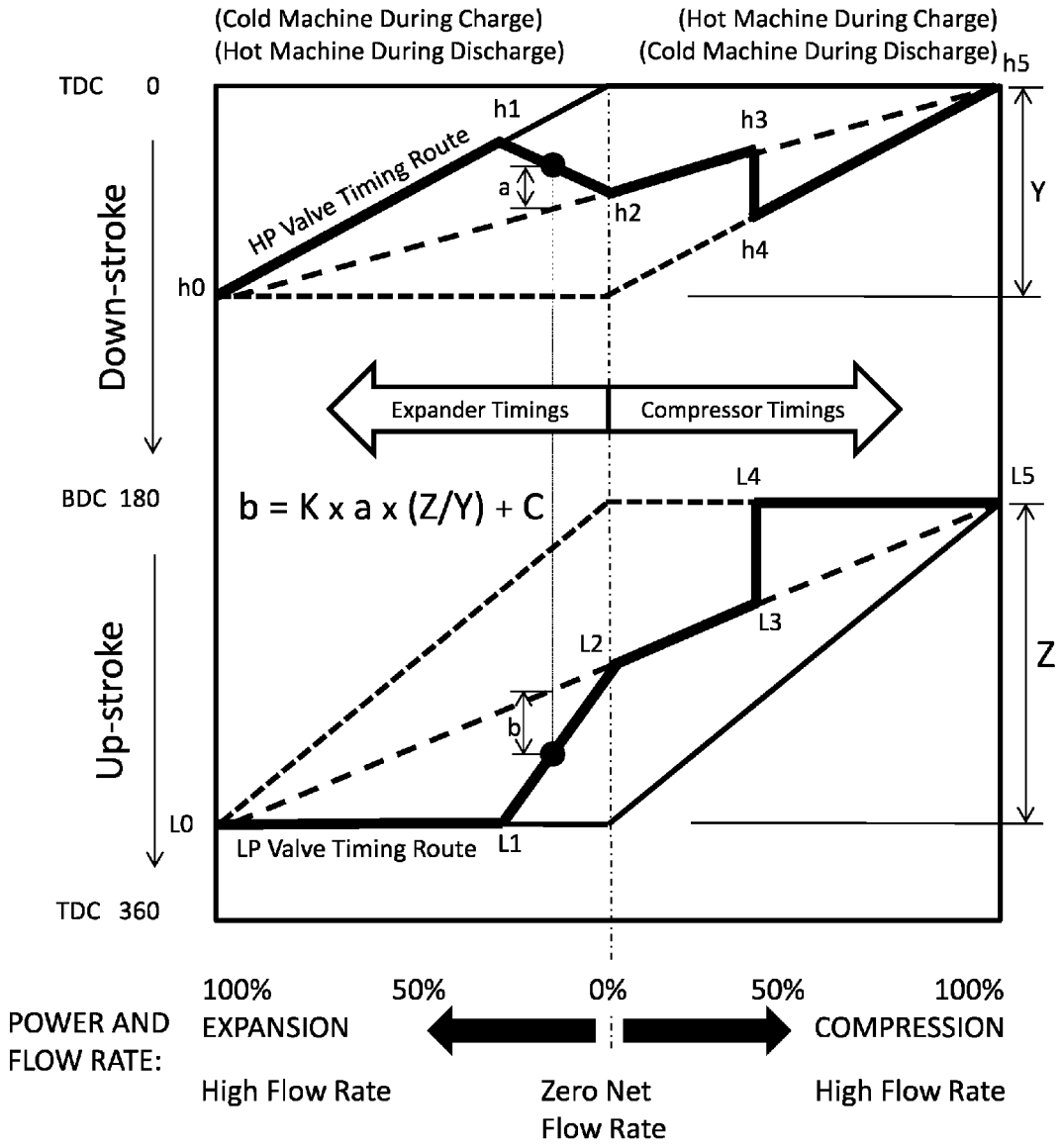

In accordance with a second aspect, there is further provided an apparatus for compressing and/or expanding a gas comprising a positive displacement device having a space forming a working volume for compressing or expanding the gas between a lower pressure LP region and a higher pressure HP region to which it is respectively connected via at least one LP valve and via at least one HP valve, the apparatus further comprising a control system for actuating the HP and LP valves, wherein the control system is configured to run an operating mode of the apparatus that implements an algorithm using the relationship $b=K\,a(Z/Y)+C$ that links the timing of every HP closure event to a LP valve closure event, whereby a, b, Y and Z are as identified according to FIG. 12 and K and C are constants of proportionality, in order to determine the LP and/or HP valve closure events for that operating mode. The constants of proportionality will vary for different respective types of systems. For example it may depend upon the amount of dead volume and/or the pressure ratio between HP and LP regions and/or any pressure drop through valves. For a system where the dead volume is minimal, the pressure ratio is modest and the pressure loss through valves is low, K will tend to 1 and C will tend to zero, in other words b will tend to equal $a(Z/Y)$.

Figure 10:
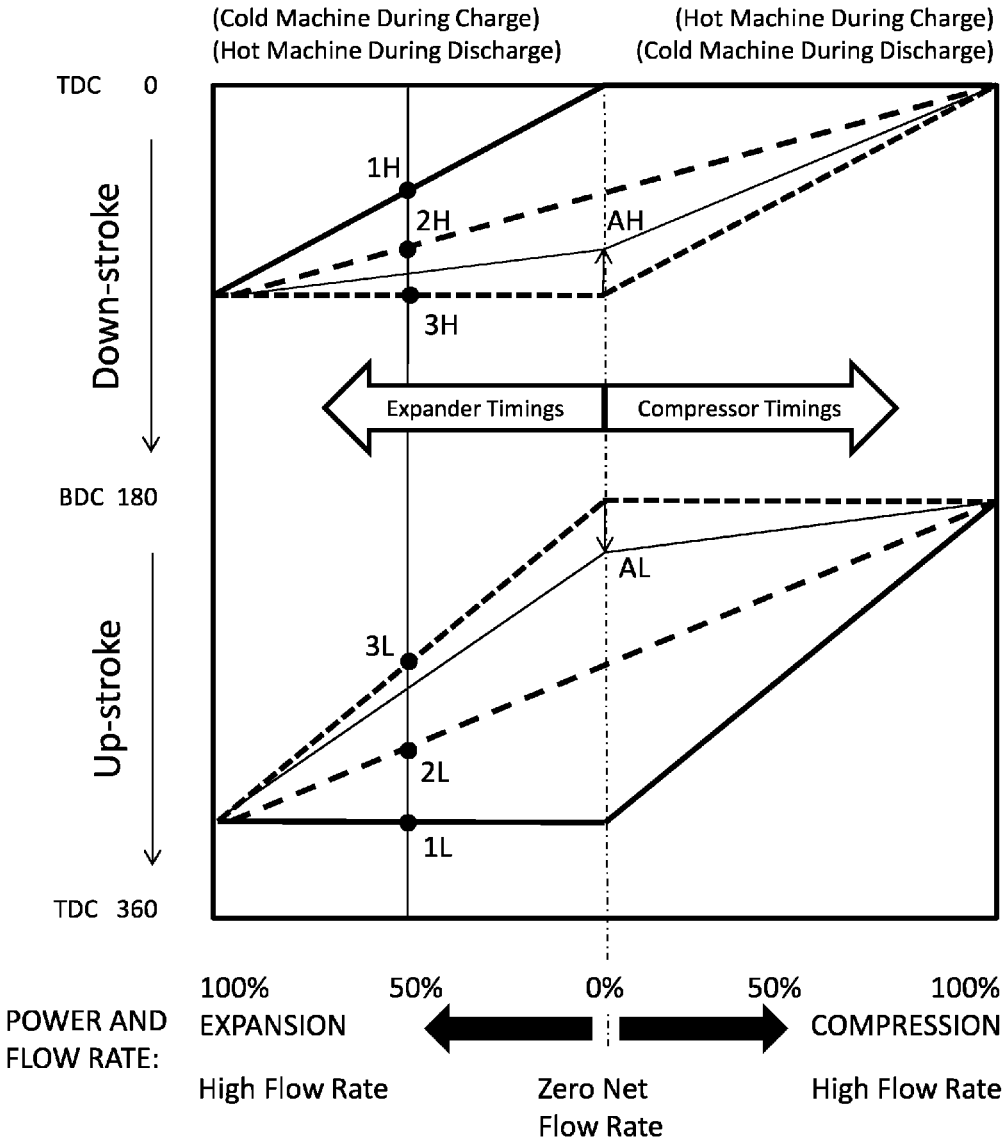
FIGS. 10, 11 and 12 are listed and described below in relation to the second aspect of the invention.

Applicant is first to appreciate the control logic that the LP and HP valve timings for a particular % flow rate are related in that they are a scaled mirror image of each other about Path 2, as FIG. 10. That is, by knowing the HP valve timing and the desired % flow rate, the LP valve timing could be determined using a scale rule about Path 2.

In one operating mode, either b or a is determined for a chosen a or b value, respectively, to determine the timing of a valve closure event using the relationship $b=Ka(Z/Y)+C$.

In one embodiment, the operating mode involves variation of the flow rate over a series of cycles from a first selected gas flow rate to a second selected gas flow rate whereby each value lies anywhere between a 0 and 100% HP region to LP region (expansion type) flow rate and/or a 0 and 100% LP region to HP (compression type) region flow rate and wherein a combined LP and HP valve timing route is determined using the relationship $b=Ka(Z/Y)+C$.

In one embodiment, the operating mode comprises at least one cycle in which there is either a net gas flow from the LP to HP region or a net gas flow from the HP to LP region, and there is also bidirectional flow of gas through both the at least one HP valve and at least one LP valve during that cycle.

In accordance with a second aspect, there is further provided an apparatus for compressing and/or expanding a gas comprising a positive displacement device having a space forming a working volume for compressing or expanding the gas between a lower pressure LP region and a higher pressure HP region to which it is respectively connected via at least one LP valve and via at least one HP valve, the apparatus further comprising a control system for actuating the HP and LP valves, wherein the control system is configured to run an operating mode of the apparatus in which there is variation of the flow rate from one value to another value both lying between 100% compression flow rate and 100% expansion flow rate per cycle and both LP and HP valve timings are changing between at least some adjacent cycles.

Applicant is first to appreciate that variation of flow rate through a series of unloaded states may be carried out by changing both the HP and LP valve timings.

In accordance with a second aspect, there is further provided an apparatus for compressing and expanding a gas comprising a positive displacement device having a space forming a working volume for compressing or expanding a gas between a low pressure region and a high pressure region to which it is respectively connected via at least one LP valve and via at least one HP valve, the apparatus further comprising a control system for actuating the HP and LP valves, wherein the control system is configured to run an operating mode of the apparatus in which flow rate gradually changes such that the function of the working volume changes from compression to expansion, or vice versa, over a series of cycles (in a series of steps that could be graduated or continuous) by changing the timing of the respective HP and LP valve closure events.

Applicant is first to appreciate that rather than switching immediately from a compression setting to an expansion setting, this can be achieved as a gradual alteration of flow rate using HP and LP valve closure events.

For example, the control system may gradually change the function of the working volume from 80% compression flow rate to 80% expansion flow rate, either continuously or, for example, in steps of 5%. The change may happen over 1, 3 cycles or 10 or 50 or 100 cycles.

In one embodiment, the operating mode includes at least one cycle in which a LP and HP paired valve combination lies inside a region bounded by Paths 1 and 3, as shown in FIG. 10.

In one embodiment, the operating mode includes at least one cycle in which a LP and HP paired valve combination lies along Path 2 and where flow rate is less than 100% compression flow rate and less than 100% expansion flow rate, as shown in FIG. 10.

In one embodiment, the operating mode includes following a particular LP valve closure timing path to vary flow rate (using partially unloaded states) between respective cycles that is linked to an associated matched HP valve closure timing path.

In one embodiment, any pair of matched LP and HP valve closure timing paths in an operating mode are each scaled mirror images as shown in FIG. 12.

In one embodiment, the operating mode involves variation of the flow rate from one value to another value both lying between 0% compression flow rate and 100% compression flow rate per cycle. Hence, the amount of compression may be modulated.

In one embodiment, the operating mode involves variation of the flow rate from one value to another value both lying between 0% expansion flow rate and 100% expansion flow rate per cycle. Hence, the amount of expansion may be modulated.

In one embodiment, the operating mode involves variation of the flow rate from one value to another value both lying anywhere within the total range defined by 100% compression flow rate and 100% expansion flow rate per cycle. Moreover, the function of the working volume could change from compression to expansion and vice versa.

In one embodiment, the gas flow rate is varied in a continuous or stepwise manner.

In one embodiment, the positive displacement device is a linear device and is preferably a reciprocating piston assembly. The valves are preferably laterally reciprocating valves. Ideally, the valves are laterally and linearly reciprocating, multi-apertured screen valves.

In one embodiment, the control system is configured only to control the timing of the LP and HP valve closure events.

As will be appreciated from above, where the positive displacement device (e.g. a half-engine) needs to function alternately as both a compressor and expander (e.g. in a thermodynamic system), the second aspect allows its function to switch by gradually changing flow rate through the device over a series of cycles from a chosen % compression power to a selected % expansion power (or vice versa) by changing HP and LP valve closure events.

The device is preferably configured such that the HP and/or LP valves open either when there is minimal gas in the working volume or when the pressure across the valve is at or near pressure equalisation. Ideally, the device is configured such that the HP and/or LP valves open automatically at or near pressure equalization. If the valve is required to open when there is not pressure equalisation this could be done with the use of a poppet valve and associated cam shaft/actuator to open the valve against any pressure difference. This is normally not a preferred embodiment as this opening will result in an energy loss unless the amount of working volume is minimal at this point, for example only the dead volume at TDC. Advantageously, the device is configured such that a valve closure signal has no effect when a valve is already closed.

As indicated earlier in relation to the 1st aspect, Applicant's earlier application, WO2009074800, describes a lightweight sliding screen valve comprising a flexible multi-apertured valve plate configured for lateral reciprocation, which can conform to the face of a multi-apertured valve seat due to its flexibility and hence provide a good quality seal in response to a pressure differential across the valve, and also lock in the closed configuration in response to the pressure differential. It is designed to open automatically upon pressure equalization and is designed to open and close quickly, which makes it suitable for use in a half-engine of a PHES system and in a half-engine where gas mass flow rates are preferably only controlled by valve closure timing events, as described in relation to the first aspect.

In an embodiment (a) where only valve closure events are controlled, the control system is configured to decrease (or respectively increase) net mass flow through a half-engine acting as an expander by advancing (resp retarding) the closure of the high pressure (inlet) valve on the downstroke, optionally whilst using almost the full exhaust stroke for exhaust.

In an embodiment (b) where only valve closure events are controlled, the control system is configured to decrease (or respectively increase) net mass flow through a half-engine acting as an expander by advancing (resp retarding) the closure of the low pressure (exhaust) valve on the upstroke, optionally whilst using almost the full inlet stroke for inward transfer from HP and expansion, resulting in re-compression of gas which had been expanded.

In an embodiment (c) where only valve closure events are controlled, the control system is configured to decrease (resp increase) net mass flow through a half-engine acting as a compressor by retarding (resp advancing) the closure of the low pressure (inlet) valve on the upstroke, optionally whilst using almost the full intake stroke for intake.

In an embodiment (d) where only valve closure events are controlled, the control system is configured to decrease (resp increase) net mass flow through a half-engine acting as a compressor by retarding (resp advancing) the closure of the high pressure (exhaust) valve on the downstroke, optionally whilst using almost the full exhaust stroke for compression and outward transfer to HP, resulting in re-expansion of gas which had been compressed.

In a further embodiment there is contemplated a combination of embodiments a and b directly above.

In a further embodiment there is contemplated a combination of embodiments c and d directly above.

The apparatus may form part of a system for carrying out a gas based thermodynamic cycle, for example, a PHES system, as described in connection with the first aspect above.

There is further provided apparatus for compressing and/or expanding a gas comprising a positive displacement device substantially as hereinbefore described with reference to any of FIG. 4 to 6, or 8 to 12. The apparatus may be pre-programmed to follow a valve timing route involving variation of flow rate and including at least some LP and HP paired valve combinations lying inside a region bounded by and including Paths 1 and 3 and calculated using the relationship $b=Ka(Z/Y)+C$.

There is further provided a method of operating apparatus as described above, wherein the control system carries out a mode of operation as specified above.

BRIEF DESCRIPTION OF THE DRAWINGS

The present invention in its second aspect will now be described, by way of example only, with reference to earlier FIGS. 5, 6, 8 and 9 and the additional drawings in which:—

Figure 11:
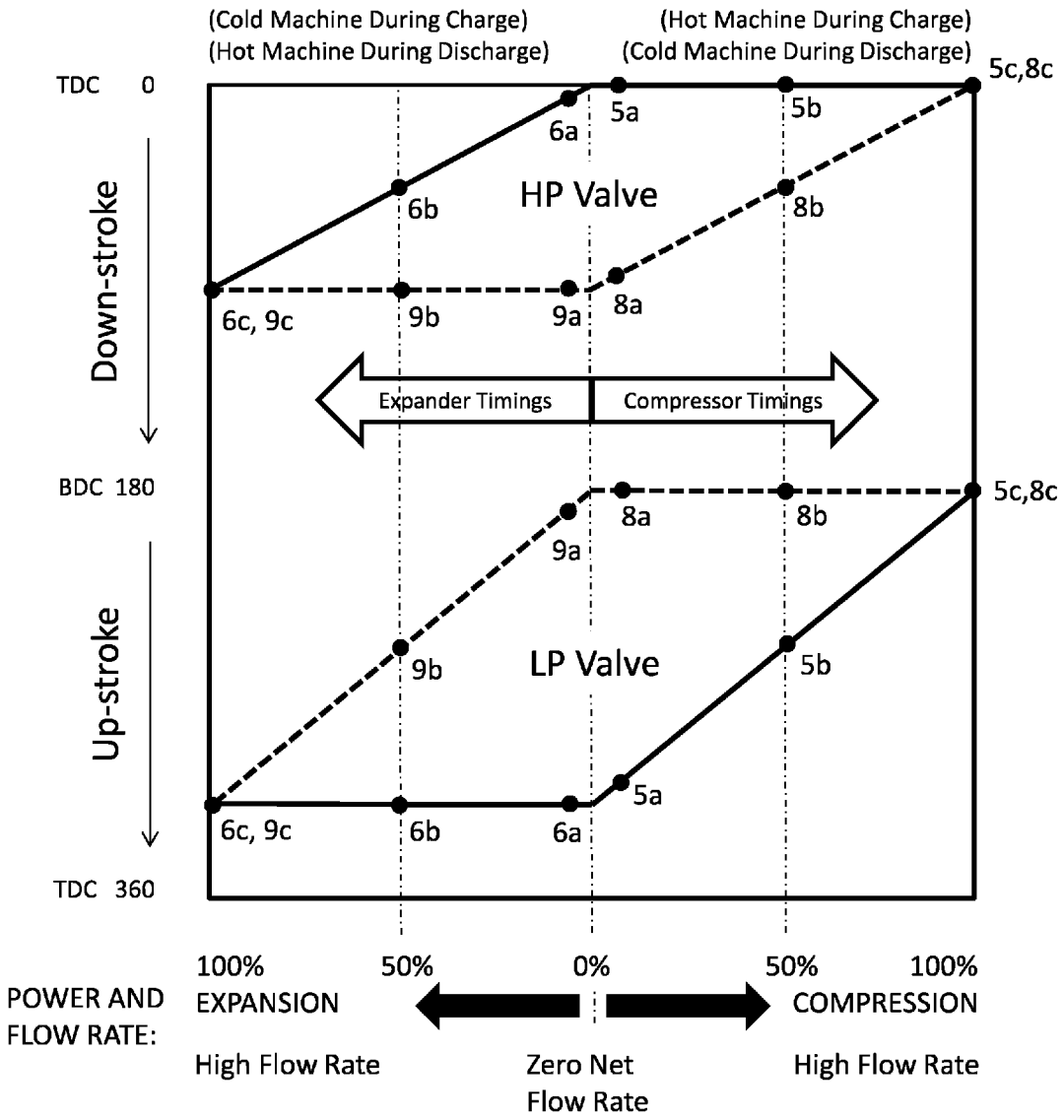

FIG. 10 is a diagram illustrating (only) valve closure timing options for a high pressure valve and low pressure valve at different piston positions for continuous control of compressor/expander power; and, FIG. 11 is the same diagram as FIG. 10 but plotting the examples of different compressor and expander powers illustrated individually in FIGS. 5, 6, 8 and 9; and, FIG. 12 is the same diagram as FIG. 10 but plotting valve timing routes using matched pairs of LP and HP valve closure events.

When the term flow rate is used in this text it refers to volumetric flow rate and in particular the net volumetric flow rate through the LP valve. The working volume has fixed geometry and the maximum volume of gas that can be compressed each cycle is limited to this working volume and the mass flow is limited to that volume of gas at that particular temperature and pressure. The maximum amount of gas that can be expanded is equal to the maximum volume that can be exhausted from the chamber when the LP valve is open.

Mass flow rate will be determined by the maximum working volume, the actual pressure at that low pressure, the type of gas and the temperature. A change in the pressure of the low pressure region will change the mass flow rate, but it will not affect volumetric flow rate as defined above. Likewise a change in the pressure of the low pressure region might negate the effect of a change in volumetric flow rate, such that the mass flow rate is constant even though the volumetric flow rate has changed. Changing valve timing changes volumetric flow rate, which normally leads to a change in mass flow rate. For simplicity, when flow rate is referred to it means volumetric flow rate. This aspect of the invention is concerned with changes in volumetric flow rate that may or may not lead to changes in mass flow rate.

For a reciprocating linear device, the volumetric flow rate on the LP side is determined by the net fraction of stroke used for the lower pressure transfer ("net" covers the bidirectional flow case). The mass flow rate is determined by this volumetric flow rate together with prevailing density at the LP side. Density is a function of pressure and temperature, as expressed in the equation of state for the working fluid.

FIGS. 10 and 11—Control of Valve Closure Timing Events

As mentioned in relation to the 1st aspect above, continuously variable valve train and associated control systems could be used for both the high pressure and the low pressure valves in a reciprocating machines, in order gradually and differentially to change the flow rates through the machines by changing their respective opening and closing times. However, it is more convenient to use reciprocating units configured so that both the low and high pressure valves open, preferably automatically (without requiring an activation signal), when there is pressure equalisation between the compression/expansion chamber and the inlets/outlets for the valves. When using such an approach, the compression ratio within the chamber is automatically adjusted to system requirements and flow rates and hence, compressor/expander internal power can be controlled by only changing the timing of the valve closure events.

This enables a control system to be developed where multiple timing diagrams similar to those shown in FIGS. 5, 6, 8 and 9 can be combined into points on a look-up table or map for preferably graduated (e.g. continuous) control of compressor/expander power. Such a map is shown in FIG. 10, where the necessary valve closing timings for both the high HP and low LP pressure valves are shown for possible compressor/expander power settings. The lines 1, 2 & 3 on the graph show certain possible options with respect to valve closing timing for continuous control of compressor/expander power (note that there might be slight differences to the timing angles dependent on datum/ambient temperature and whether the graph applies to either a hot machine/compressor or cold machine/expander).

The vertical axis shows the amount of downstroke or displacement in the chamber (as opposed to crankshaft angle, which would be slightly different) after top dead centre, TDC (e.g. if the piston is driven by a crankshaft and connecting rod arrangement—refer to FIG. 3), with piston TDC and bottom dead centre, BDC, highlighted (which correspond to 0.180 and 360 degrees crank angle) respectively.

FIG. 10 shows that there can be a continuous transition from compressor to expander by a combined change in the closing timing of the high pressure and the low pressure valves. Any of the three paths can be used to achieve this (including any perceived path in-between those defined by paths 1 and 3), but route one is the preferred option as it is potentially the most efficient from a thermodynamic perspective. An example alternate path from line 3 (short dotted) is shown by the arrows and the path outlined by the thin black line (lines labelled AH and AL).

The methods of compression and expansion previously identified above in relation to the 1st aspect can now be discussed in the context of this diagram as follows: Compression (LP to HP)

The first compression method is as indicated in the timing diagrams of FIGS. 5*a*, 5*b*, and 5*c*. Where the compression flow rate is between 100% and 0% LP to HP, this may be achieved by reducing the amount of gas compressed on each stroke ie some of the LP gas that has been drawn into the working volume is ejected prior to the closure of the LP valve. In this way the flow rate is reduced from LP to HP. It should be noted that flow through the LP valve is bidirectional in this mode and the flow through the HP valve is unidirectional. FIGS. 5*a*, 5*b* and 5*c* show a low, medium and high net flow rate from LP to HP.

The three paired HP and LP valve timing combinations are now plotted on FIG. 11 where they form a valve timing path which is identified as Path 1 on FIG. 10. This is a thermodynamically preferred route.

The second compression method is as indicated in the timing diagrams of FIGS. 8*a*, 8*b*, and 8*c*. This reduced flow rate may be achieved by re-expanding some of the compressed HP gas into the working volume so that the amount of additional new LP gas that can be drawn into the working volume is reduced. In this way the flow rate is reduced from LP to HP and it should also be noted that the flow through the HP valve is bi-directional and that through the LP valve is unidirectional.

The three paired HP and LP valve timing combinations are now plotted on FIG. 11 where they form a valve timing path which is identified as Path 3 on FIG. 10. This is a thermodynamically less preferred route.

Expansion (HP to LP)

The first expansion method is as indicated in the timing diagrams of FIGS. 6*a*, 6*b*, and 6*c*. Where the expansion flow rate is between 100% and 0% HP to LP, this may be achieved by reducing the amount of gas expanded on each stroke ie less HP gas is drawn into the working volume, so the LP valve opens early and some LP gas is drawn into the working volume before being ejected again. In this way the flow rate is reduced from HP to LP. It should be noted that flow through the LP valve is bidirectional in this mode and the flow through the HP valve is unidirectional.

The three paired HP and LP valve timing combinations are now plotted on FIG. 11 where they form a valve timing path which is identified as Path 1 on FIG. 10. This is a thermodynamically preferred route.

The second expansion method is as indicated in the timing diagrams of FIGS. 9*a*, 9*b*, and 9*c*. This reduced flow rate may be achieved by re-compressing some of the expanded LP gas into the working volume so that the amount of additional new HP gas that can be drawn into the working volume is reduced. In this way the flow rate is reduced from HP to LP and it should also be noted that the flow through the HP valve is bi-directional and that through the LP valve is unidirectional.

The three paired HP and LP valve timing combinations are now plotted on FIG. 11 where they form a valve timing path which is identified as Path 3 on FIG. 10. This is a thermodynamically less preferred route.

The above modes of operation have linked sets of valve timings that must occur at a certain time for that compression or expansion flow rate to occur. In all cases one valve timing is kept approximately constant, while the other valve timing is varied. There is normally a crossover at approximately zero flow when the valve timing that was being varied is then held approximately constant while the other valve timing is now varied. Clearly there is a non-linearity in this change in valve timing.

There exists what may be regarded as a third compression and expansion method beyond the first and second methods above, which will now be described, and which is a combination of the first and second methods.

Third compression method (any linked valve timing that falls between 5*a*,5*b*,5*c* and 8*a*,8*b*,8*c* on FIG. 11). There is a combined compression method that involves ejecting some of the LP gas drawn into the working volume to reduce the amount that is actually compressed AND also re-expanding some of the compressed HP gas so that the amount of new LP gas that can be drawn into the working volume is further reduced. In this way the flow rate is reduced from LP to HP. It should be noted that the flow through the HP and LP valves are bi-directional.

The first and second compression options are limited to a single set of valve timings for HP and LP for a certain % gas flow rate—ie if 50% flow rate from LP to HP was required using method one then there is only one position of HP valve closure and one position of LP valve closure that will allow this 50% flow rate. If the third (combined) compression method is used there are a range of timings that can be used for both LP and HP valves, however the selection of one timing for either the HP or LP valve will in turn force the timing of the other valve as these timings are linked.

Third expansion method (any linked valve timing that falls between 6*a*,6*b*,6*c* and 9*a*,9*b*,9*c* on FIG. 11). There is a combined method that involves reducing the amount of HP gas drawn into the working volume to reduce the amount that is actually expanded AND also re-compressing some of the expanded LP gas so that the amount of new HP gas that can be drawn into the working volume is further reduced. In this way the flow rate is reduced from HP to LP. It should be noted that the flow through the HP and LP valves are bi-directional.

Like the compression options, the first and second expansion options are limited to a single set of valve timings for HP and LP for a certain % gas flow rate—ie if 50% flow rate from LP to HP was required using method one then there is only one position of HP valve closure and one position of LP valve closure that will allow this 50% flow rate. If the third (combined) expansion method is used there are a range of timings that can be used for both LP and HP valves, however the selection of one timing for either the HP or LP valve will in turn force the timing of the other valve as these timings are linked.

Furthermore this method of timing allows for a range of flow values, which lies entirely within a range of values for flow rates from 100% compression flow rate from LP to HP to 100% expansion flow rate from HP to LP or covers any value in between these two limits ie 53% compression flow rate or 21% expansion flow rate. That is to say, a control system may include an operating mode in which flow value may be varied over both compression and expansion % flow rate values such that the system is configured gradually to change the function of the working volume between a selected % compression flow rate and a selected % expansion flow rate.

According to a preferred embodiment of the present invention in its second aspect, a linear change in valve timing for both HP and LP may be adopted, such that the valve timing changes linearly with piston position and flow rate. This linear change could be a straight line, such as Path 2 (see 2H and 2L) as shown in FIG. 10. This may be advantageous for use in apparatus where there are mechanical cams for implementing the change in timing. It must be noted that the implementation of such a control system for setting the valve timings of both the high pressure and low pressure valves could also involve the use of electro-mechanical rotary actuators similar to the popular camshaft phasing mechanisms, typically found in automotive applications.

The control system may be configured to be able to follow a series of pre-programmed valve timing paths that extend partially or fully between 100% compression flow rate and 100% expansion flow rate, which paths are thermodynamically different and may use varying degrees of compression of LP gas, re-compression of LP gas that has previously been expanded within the same cycle, expansion of HP gas and re-expansion of HP gas that has previously been compressed within the same cycle.

The variation in loading using multiple pre-programmed paths may also be confined to the same function. The control system may be configured to be able to follow a series of pre-programmed valve timing paths that extend partially or fully between 100% compression flow rate and 0% compression flow rate, which paths are thermodynamically different and may use varying degrees of compression of LP gas and re-expansion of HP gas that has previously been compressed within the same cycle (or vice versa for varying expander loading). For example, the control system may be configured (e.g. pre-programmed) gradually to change the function from 80% compression flow rate to 60% compression flow rate, either continuously or, for example, in steps of 5%.

In a further variation, the control system may be configured such that the function of the working volume can be anywhere within a range between maximum 100% compression flow rate and maximum 100% expansion flow rate (i.e. it can be operated in any particular selected unloaded state) AND where the valve closure positions may change from cycle to cycle, BUT where the target flow rate does not change.

FIG. 12—Matched Pairs of HP and LP Valve Closure Events

FIG. 12 demonstrates that there is a relationship between HP and LP valve closure events.

Referring to FIG. 12, this shows the previously described timing diagram with a closure timing path shown in bold that employs a combination of two different compression and two different expansion methods.

The high pressure valve closures all take place on the downstroke and occur from TDC to a second point mid-stroke between BDC and TDC. The exact placement of this second point depends upon the difference in pressure between HP and LP. Generally as the difference between HP and LP increases the position of the second event moves upwards towards TDC. The difference between the position of the piston at BDC and the second point is shown as Y on the figure. The magnitude of Y decreases as the pressure ratio increases (difference between HP and LP regions). Y is effectively always measured from TDC.

The low pressure valve closures all take place on the upstroke and occur from BDC to a second point close to TDC. The exact placement of this second point depends upon the difference in pressure between HP and LP. Generally as the difference between HP and LP increases the position of the second event moves away from TDC. The distance between the position of the piston at BDC and the second point is shown as Z on the figure. The magnitude of Z decreases as the pressure ratio increases (difference between HP and LP regions). Z is effectively always measured from BDC.

Exemplary Valve Timing Path

The timing path shown in bold on the diagram will now be described in detail. The high pressure valve closures follow the route h0 to h5 and the low pressure valve closures follow the route L0 to L5. Any change in the closure of the valve timing of the HP valve must be mirrored by a change in the closure of the timing of the LP valve so that the positions of the closures match those shown by the bold line that are vertically in line with each other. For example if zero net flow rate is required and the HP valve is closed on the downstroke when the piston is at position h2 then the matching LP valve must be closed on the upstroke when the piston is at position L2.

Timing Path at Point 0

Starting from 100% expansion flow rate the HP valve is closed when the piston is at position h0 on the downstroke and the LP valve is closed when the piston is at position L0 on the upstroke. All timing paths must start at this position for 100% expansion flow rate.

Timing Path at Point 5

The timing path finishes at 100% compression flow rate when the HP valve is closed at TDC and the LP valve at BDC. Again all timing paths must finish at this position for 100% compression flow rate.

Mirror Lines

It can be seen that there is a dashed line that connects h0 and h5 as well as one between L0 and L5. These lines are important as all valve events are effectively mirrored around these lines in a vertical sense. These lines will be referred to as HP and LP mirror lines. For example there is a dot that shows a valve event between h1 and h2. It can be seen that this dot occurs at a position that is a distance 'a' ABOVE the dashed HP mirror line. As has previously been explained the timing of the HP valve closure controls the timing of the LP valve closure for a certain flow rate (or vice versa). The equivalent LP valve closure must therefore occur a distance 'b' BELOW the dashed LP mirror line, where $$b=Ka(Z/Y)+C,$$

and K and C are constants of proportionality which will vary for different respective types of systems. For example it may depend upon the amount of dead volume and/or the pressure ratio between HP and LP regions and/or any pressure drop through valves. For a system where the dead volume is minimal, the pressure ratio is modest and the pressure loss through valves is low, K will tend to 1 and C will tend to zero, in other words b will tend to equal a(Z/Y).

Timing Path from 0 to 1.

As the expansion flow rate is lowered from 100% to approximately 30% the valve closure events are changed in line with first expansion method ie where the amount of HP gas that is to be expanded is reduced to reduce flow rate.

Timing Path from 1 to 2.

As the expansion flow rate is lowered from approximately 30% to 0% the valve closure events are changed in line with the third expansion method ie where there is a combination of reduced volume of HP gas to expand and some of the LP gas is also recompressed to reduce the amount of new HP gas that enters the working volume.

Timing Path from 2 to 3

The compression flow rate increases from 0% to 50% while valve closure events follow the mirror line and are in line with the third compression method ie where there is a combination of reduced LP gas to compress and re-expansion of HP gas to reduce the amount of new LP gas drawn into the working volume.

Timing Path from 3 to 4

The compression flow rate does not change as the HP valve closures change position from h3 to h4, while being matched by changes in the position of the LP closures form L3 to L4.

Timing Path from 4 to 5

The compression flow rate increases from 50% to 100% while valve closure events are in line with the second compression method ie where there is re-expansion of HP gas to reduce the amount of new LP gas drawn into the working volume.

The timing path in FIG. 12 is shown as a series of straight lines between certain points. Alternatively a valve timing path might be a curve that starts and stops at the 100% compression flow rate and 100% expansion flow rate points, but remains within the paths bounded by routes 1 and 3. In fact as shown in FIG. 12 the timing path can effectively be any shaped line within the timing paths bounded by path 1 and 3. Indeed the timing path may even 'doubleback' on itself if required. However, if it does doubleback on itself it must be understood that at these points on the timing path any change in valve timing (either backwards or forwards along the timing path) will only result in a change in the flow in one direction. For example both directions may temporarily lead to an increase in compression flow rate or both lead to an increase in expansion flow rate.

The reason for following some of these alternative timing paths is that there may be an advantage in that certain timing paths use valve timings that can reduce the mechanical friction of the piston ring (if used) or of bearings (if used) in the machine performing the reciprocation.

In view of the above, a control system may be configured to run an operating mode of the apparatus that implements an algorithm using the relationship b=Ka(Z/Y)+C that links the timing of every HP closure event to a LP valve closure event, whereby a, b, Z and Y are as identified according to FIG. 12 and K and C are constants of proportionality that vary depending upon the actual system configuration, in order to determine the LP and/or HP valve closure events for that operating mode.

Applicant is first to appreciate the control logic that the LP and HP valve timings for a particular % flow rate are related in that they are a scaled mirror image of each other about Path 2. That is, by knowing the HP valve timing and the desired % flow rate, the LP valve timing could be determined using a scale rule about Path 2.

In one operating mode, either b or a is determined for a chosen a or b value, respectively, to determine the timing of a valve closure event using the relationship $b=Ka(Z/Y)+C$ as defined above.

This invention particularly addresses methods of changing the volumetric flow rate on a per cycle basis of reciprocating machinery, ie independent of the speed of reciprocation. This is particularly applicable to constant speed machines, although it can also be applied to variable speed machines.

The present invention further provides any novel and inventive combination of the above mentioned features which the skilled person would understand as being capable of being combined.

The invention claimed is:

1. A system configured to operate a gas based thermodynamic cycle, the system comprising:

an apparatus in which a working fluid that is only gaseous circulates in an open or closed circuit, the apparatus being configured to operate at least one of a thermodynamic heat pump and a heat engine cycle, the circuit including at least one compressor and at least one expander connected in series upstream or downstream of one another within the circuit, such that the at least one compressor and the at least one expander simultaneously compress and expand the gaseous working fluid, respectively; and respective operating temperatures of the at least one compressor and the at least one expander differ from one another, such that a change in absolute internal power with gas mass flow rate differs as between the compressor and the expander; and an electronic control system that is programmed selectively individually and independently to adjust respective gas mass flow rates through each of the simultaneously operating at least one compressor and at expander so as to provide independent control of first and second system variables, the first and second system variables being a power variable and a pressure or pressure related variable associated with the system.

2. The system according to claim 1, wherein the control system is configured to increase or decrease the first system variable whilst maintaining the second system variable constant.

3. A system according to claim 1, configured as an energy storage system, the energy storage system comprising:

a first stage comprising:

a hot half-engine operable as the at least one compressor during a charging mode and as the at least one expander during a discharging mode and, wherein the hot half-engine comprises at least one single reversible machine or respective machines to implement compression and expansion functions; and a first heat store configured to receive and store thermal energy from gas compressed by the hot half-engine in the charging mode, and configured to transfer thermal energy to the gas compressed by the cold half-engine in the discharging mode; and a second stage comprising:

a cold half-engine operable as the at least one expander to receive gas from the first heat store during the charging mode, operable as the at least one compressor driving gas into the first heat store during the discharging mode, and comprising a single reversible machine or respective machines to implement compression and expansion functions; and a second heat store configured to transfer thermal energy to gas expanded by the cold half-engine during the charging mode, and configured to receive and store thermal energy from gas expanded by the hot half-engine during the discharging mode.

4. A system according to claim 3, wherein the system is configured to use an external power input during the charging mode and to generate an external power output during the discharging mode, wherein the control system is further configured to provide independent graduated control of a pressure or pressure related variable associated with the system and independent graduated control of the external power input or output of the system by selective adjustment of a gas flow rate through the hot half-engine and a gas flow rate through the cold half-engine.

5. A system according to claim 3, wherein the control system is further configured to implement an algorithm using an external power input or output and a system internal condition as input, wherein the algorithm calculates respective mass flow rates of the hot and cold half-engines as output.

6. A system according to claim 3, wherein the control system is further configured to maintain a pressure of the first store or a pressure of the second store within an optimum range, or, at an optimum value.

7. A system according to claim 3, wherein the control system is further configured to maintain an output temperature of the hot half-engine within an optimum range, or, at an optimum value.

8. A system according to claim 3, wherein the control system is further configured to increase or decrease external power input or output whilst maintaining a pressure variable constant by increasing or decreasing the respective mass flow rates through the hot and cold half-engines by the same amount.

9. A system according to claim 3, wherein the control system is further configured to control a pressure variable whilst maintaining external power input or output constant by changing the mass flow rates through the hot and cold half-engines by selected differing amounts that do not affect the external power input or output.

10. A system according to claim 3, wherein one or both of the hot half-engine and the cold half-engine comprises a positive displacement device, the positive displacement device comprising a reciprocating valved device through which internal power and mass flow rate are controlled by selective alteration of valve timings.

11. The system according to claim 1, wherein one or both of the at least one compressor and at least one expander comprise multiple compressor/expander stages and the control system is further configured to control mass flow rates differentially between individual stages of the compressor/expander stages in order to maintain inter-stage pressures at desired values.

12. The system according to claim 1, wherein one or both of the at least one compressor and at least one expander comprises a positive displacement device, the positive displacement device comprising a reciprocating valved device through which internal power and mass flow rate is controlled by selective alteration of valve timings.

13. The system according to claim 12, wherein the valved device is a reciprocating piston assembly comprising a working volume respectively connected via a high pressure valve to a high pressure region and via a low pressure valve to a low pressure region.

14. The system according to claim 13, wherein the valved device is configured such that both the high pressure valve and the low pressure valve open on pressure equalisation, and the control system is further configured only to control the timing of valve closure events of the high pressure valve and the low pressure valve.

15. The system according to claim 14, wherein the control system is further configured to mechanically determine the timing of valve closure events based on an external power input or output and on at least one system internal condition.

16. The system according to claim 14, wherein the control system is further configured to electronically determine the timing of valve closure events based on an external power input or output and on at least one system internal condition.

17. The system according to claim 14, wherein the control system is further configured to determine valve timing adjustments for an external power input or output, or to determine pressure modification based on parametric inputs, the parametric inputs comprising at least one current system internal condition and at least one current system external condition.

* * * * *